US008929760B2

(12) United States Patent
Tanaka et al.

(10) Patent No.: US 8,929,760 B2
(45) Date of Patent: Jan. 6, 2015

(54) TRANSFER DEVICE WITH BIAS OUTPUT DEVICE AND IMAGE FORMING APPARATUS INCLUDING SAME

(71) Applicants: Shinya Tanaka, Kanagawa (JP); Naomi Sugimoto, Kanagawa (JP)

(72) Inventors: Shinya Tanaka, Kanagawa (JP); Naomi Sugimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 86 days.

(21) Appl. No.: 13/651,776

(22) Filed: Oct. 15, 2012

(65) Prior Publication Data

US 2013/0121714 A1 May 16, 2013

(30) Foreign Application Priority Data

Nov. 14, 2011 (JP) ..... 2011-248575
Jul. 13, 2012 (JP) ..... 2012-157388

(51) Int. Cl.
*G03G 15/16* (2006.01)

(52) U.S. Cl.
CPC ..... *G03G 15/1675* (2013.01)
USPC ..... 399/66; 399/101

(58) Field of Classification Search
USPC ..... 399/66, 101
See application file for complete search history.

(56) References Cited

U.S. PATENT DOCUMENTS 5,386,274 A 1/1995 Sanpe et al.
5,749,022 A 5/1998 Kikui et al.
6,731,890 B1 * 5/2004 Rakov et al. ..... 399/66
6,766,125 B1 * 7/2004 Izumi ..... 399/66
6,804,481 B2 * 10/2004 Mochizuki et al. ..... 399/66
7,756,455 B2 * 7/2010 Mori et al. ..... 399/302
2003/0215251 A1 * 11/2003 Mochizuki et al. ..... 399/44
2004/0001726 A1 * 1/2004 Nakano et al. ..... 399/101
2005/0244179 A1 * 11/2005 Rakov et al. ..... 399/66
2006/0245768 A1 * 11/2006 Takeda et al. ..... 399/16

(Continued)

FOREIGN PATENT DOCUMENTS

JP 8-334954 12/1996
JP 9-106192 4/1997

(Continued)

OTHER PUBLICATIONS

U.S. Appl. No. 13/526,894, filed Jun. 19, 2012, Tomokazu Takeuchi, et al.

(Continued)

*Primary Examiner* — G. M. Hyder
(74) *Attorney, Agent, or Firm* — Oblon, Spivak, McClelland, Maier & Neustadt, L.L.P.

(57) ABSTRACT

A transfer device includes a rotatable image bearing member to bear a toner image on a surface thereof, a nip forming member to contact the surface of the image bearing member, and a bias output device to output a bias current to alternately form a transfer-direction electric field to transfer toner charged with a normal polarity in a toner image formed on the image bearing member to move therefrom to a recording medium and a return-direction electric field to return the toner from the recording medium to the image bearing member. A transition time T1 from a first time at which a current for forming the transfer-direction electric field reaches its maximum (It) to a second time at which a current for forming the return-direction electric field reaches its maximum (Ir) is longer than a transition time T2 from the second time to the first time.

18 Claims, 24 Drawing Sheets

(56) References Cited

U.S. PATENT DOCUMENTS

| | | | | |
|---|---|---|---|---|
| 2007/0231010 | A1 | 10/2007 | Ohta et al. | |
| 2008/0095553 | A1 | 4/2008 | Tanaka et al. | |
| 2008/0118286 | A1 | 5/2008 | Yamashita et al. | |
| 2008/0138132 | A1 | 6/2008 | Yamashita et al. | |
| 2008/0170878 | A1 | 7/2008 | Yamashita et al. | |
| 2008/0193178 | A1 | 8/2008 | Sugimoto et al. | |
| 2008/0193179 | A1 | 8/2008 | Sugimoto et al. | |
| 2008/0253815 | A1 | 10/2008 | Yano et al. | |
| 2008/0260401 | A1* | 10/2008 | Shimazaki | 399/66 |
| 2008/0310897 | A1 | 12/2008 | Naruse et al. | |
| 2009/0035038 | A1 | 2/2009 | Sugimoto et al. | |
| 2009/0092428 | A1 | 4/2009 | Yano et al. | |
| 2009/0196665 | A1 | 8/2009 | Tanaka et al. | |
| 2009/0279930 | A1 | 11/2009 | Kabata et al. | |
| 2009/0285613 | A1 | 11/2009 | Nakai et al. | |
| 2009/0290919 | A1 | 11/2009 | Tanaka et al. | |
| 2009/0304423 | A1 | 12/2009 | Ozaki et al. | |
| 2009/0311004 | A1 | 12/2009 | Naruse et al. | |
| 2009/0311014 | A1 | 12/2009 | Tanaka et al. | |
| 2010/0003052 | A1 | 1/2010 | Nakamatsu et al. | |
| 2010/0008706 | A1 | 1/2010 | Sugiura et al. | |
| 2010/0034549 | A1 | 2/2010 | Nakamatsu et al. | |
| 2010/0034560 | A1 | 2/2010 | Tanaka et al. | |
| 2010/0054829 | A1 | 3/2010 | Iio et al. | |
| 2010/0073697 | A1 | 3/2010 | Someya et al. | |
| 2010/0183972 | A1 | 7/2010 | Hasegawa et al. | |
| 2010/0209143 | A1 | 8/2010 | Nakai et al. | |
| 2010/0239302 | A1 | 9/2010 | Naruse et al. | |
| 2010/0239309 | A1 | 9/2010 | Tanaka et al. | |
| 2010/0310291 | A1 | 12/2010 | Tanaka et al. | |
| 2010/0329707 | A1* | 12/2010 | Yamada | 399/44 |
| 2011/0008088 | A1 | 1/2011 | Nakai et al. | |
| 2011/0038656 | A1 | 2/2011 | Hasegawa et al. | |
| 2011/0052286 | A1 | 3/2011 | Urayama et al. | |
| 2011/0085834 | A1 | 4/2011 | Naruse et al. | |
| 2011/0103822 | A1 | 5/2011 | Sugiura et al. | |
| 2011/0158677 | A1 | 6/2011 | Kikuchi et al. | |
| 2011/0229187 | A1 | 9/2011 | Hozumi et al. | |
| 2011/0229234 | A1 | 9/2011 | Hozumi et al. | |
| 2012/0008973 | A1 | 1/2012 | Sakakibara et al. | |
| 2012/0045231 | A1 | 2/2012 | Ogino et al. | |
| 2012/0045237 | A1 | 2/2012 | Aoki et al. | |
| 2012/0057912 | A1 | 3/2012 | Hasegawa et al. | |
| 2012/0060753 | A1 | 3/2012 | Tanaka et al. | |
| 2012/0063809 | A1 | 3/2012 | Tanaka et al. | |
| 2012/0063825 | A1 | 3/2012 | Hasegawa et al. | |
| 2012/0195662 | A1 | 8/2012 | Hasegawa et al. | |
| 2012/0230715 | A1 | 9/2012 | Ogino et al. | |
| 2012/0237234 | A1 | 9/2012 | Sugimoto et al. | |

FOREIGN PATENT DOCUMENTS

| | | |
|---|---|---|
| JP | 2001-042598 | 2/2001 |
| JP | 2006-267486 | 10/2006 |
| JP | 2011-013241 | 1/2011 |
| JP | 2012-042827 | 3/2012 |
| JP | 2012-042835 | 3/2012 |

OTHER PUBLICATIONS

U.S. Appl. No. 13/525,681, filed Jun. 18, 2012, Naomi Sugimoto, et al.

* cited by examiner

SINE WAVE RETURN RATIO 50%

| Iave (μA) \ Ipp(mA) | 5 | 6 | 7 | 8 | 9 | 10 |
|---|---|---|---|---|---|---|
| -76 | | | | | | |
| -74 | | | | | | |
| -72 | | | | | | |
| -70 | | | | | | |
| -68 | | | | | | |
| -66 | | | | | | |
| -64 | | | | | | |
| -62 | | | | | | |
| -60 | | | | | | |
| -58 | | | | | | |
| -56 | | | | | | |
| -54 | × | × | × | × | | |
| -52 | × | × | × | × | | |
| [illegible] | × | △ | × | × | | |
| [illegible] | × | △ | △ | × | | |
| -46 | △ | ○ | △ | × | | |
| -44 | × | △ | △ | × | | |
| -42 | × | × | × | × | | |
| -40 | | | | | | |

RECESSED PORTION

WHITE SPOTS

PROJECTION

○: GOOD
△: FAIR
×: POOR

SQUARE WAVE RETURN RATIO 50%

| Iave (μA) \ Ipp(mA) | 5 | 6 | 7 | 8 | 9 | 10 |
|---|---|---|---|---|---|---|
| -76 | | | | | | |
| -74 | | | | | | |
| -72 | | | | | | |
| -70 | | | | | | |
| -68 | | | | | | |
| -66 | | | | | | |
| -64 | | | | | | |
| -62 | | | | | | |
| -60 | | | | | | |
| -58 | | | | | | |
| -56 | | | | | | |
| -54 | × | × | × | × | | |
| -52 | × | × | × | × | | |
| [illegible] | × | △ | × | × | | |
| [illegible] | △ | ○ | △ | × | | |
| -46 | △ | ○ | △ | × | | |
| -44 | × | △ | △ | × | | |
| -42 | × | × | × | × | | |
| -40 | | | | | | |

RECESSED PORTION

WHITE SPOTS

PROJECTION

○: GOOD
△: FAIR
×: POOR

RETURN RATIO 45%

| Iave (μA) \ Ipp(mA) | 5 | 6 | 7 | 8 | 9 | 10 |
|---|---|---|---|---|---|---|
| -76 | | | | | | |
| -74 | | | | | | |
| -72 | | | | | | |
| -70 | | | | | | |
| -68 | | | | | | |
| -66 | | | | | | |
| -64 | | | | | | |
| -62 | | | | | | |
| -60 | | | × | | | |
| -58 | | | × | × | | |
| [illegible] | × | × | △ | × | × | |
| [illegible] | × | △ | ○ | △ | △ | |
| -52 | × | ○ | ○ | △ | △ | |
| -50 | × | ○ | ○ | ○ | △ | × |
| -48 | △ | ○ | ○ | ○ | △ | × |
| -46 | △ | ○ | ○ | ○ | ○ | × |
| -44 | × | △ | △ | △ | △ | × |
| -42 | × | × | × | × | × | × |
| -40 | | | | | | |

RECESSED PORTION

WHITE SPOTS

PROJECTION

○: GOOD
△: FAIR
×: POOR

RETURN RATIO 40%

| Iave (μA) \ Ipp(mA) | 5 | 6 | 7 | 8 | 9 | 10 |
|---|---|---|---|---|---|---|
| -76 | | | | | | |
| -74 | | | | | | |
| -72 | | | | | | |
| -70 | | | | | | |
| -68 | | | | | | |
| -66 | | | | | | |
| -64 | | | | | | |
| -62 | × | × | × | × | | |
| -60 | × | × | △ | × | | |
| -58 | × | △ | ○ | × | | |
| -56 | △ | ○ | ○ | △ | × | |
| -54 | △ | ○ | ○ | △ | △ | × |
| -52 | ○ | ○ | ○ | ○ | △ | × |
| -50 | △ | ○ | ○ | ○ | △ | × |
| -48 | △ | ○ | ○ | ○ | △ | × |
| -46 | △ | ○ | ○ | ○ | ○ | × |
| -44 | △ | △ | △ | △ | △ | × |
| -42 | × | × | × | × | × | × |
| -40 | | | | | | |

RECESSED PORTION

WHITE SPOTS

PROJECTION

○: GOOD
△: FAIR
×: POOR

RETURN RATIO 32%

| Iave (μA) \ Ipp(mA) | 5 | 6 | 7 | 8 | 9 | 10 |
|---|---|---|---|---|---|---|
| -76 | | | | | | |
| -74 | | | | | | |
| -72 | | | | | | |
| -70 | | | | | | |
| -68 | | × | × | × | | |
| -66 | × | × | △ | × | × | |
| -64 | × | × | △ | △ | × | |
| -62 | × | △ | ○ | ○ | × | × |
| -60 | △ | ○ | ○ | ○ | △ | × |
| -58 | △ | ○ | ○ | ○ | △ | × |
| -56 | △ | ○ | ○ | ○ | △ | × |
| -54 | ○ | ○ | ○ | ○ | △ | × |
| -52 | ○ | ○ | ○ | ○ | ○ | × |
| -50 | △ | ○ | ○ | ○ | ○ | × |
| -48 | △ | ○ | ○ | ○ | ○ | △ |
| -46 | △ | ○ | ○ | ○ | ○ | △ |
| -44 | △ | △ | △ | △ | △ | × |
| -42 | × | × | × | × | × | × |
| -40 | | | | | | |

RECESSED PORTION

WHITE SPOTS

PROJECTION

○: GOOD
△: FAIR
×: POOR

RETURN RATIO 16%

| Iave (μA) \ Ipp(mA) | 5 | 6 | 7 | 8 | 9 | 10 |
|---|---|---|---|---|---|---|
| -76 | | | | | | |
| -74 | | | × | × | | |
| -72 | | × | △ | △ | | |
| -70 | | × | △ | ○ | | |
| [illegible] | | △ | ○ | ○ | | |
| [illegible] | × | △ | ○ | ○ | × | |
| -64 | △ | ○ | ○ | ○ | × | |
| -62 | △ | ○ | ○ | ○ | × | × |
| -60 | ○ | ○ | ○ | ○ | △ | × |
| -58 | ○ | ○ | ○ | ○ | △ | × |
| -56 | ○ | ○ | ○ | ○ | △ | × |
| -54 | ○ | ○ | ○ | ○ | ○ | × |
| -52 | ○ | ○ | ○ | ○ | ○ | △ |
| -50 | △ | ○ | ○ | ○ | ○ | △ |
| -48 | △ | ○ | ○ | ○ | ○ | △ |
| -46 | △ | ○ | ○ | ○ | ○ | △ |
| -44 | △ | △ | △ | △ | △ | × |
| -42 | × | × | × | × | × | × |
| -40 | | | | | | |

RECESSED PORTION

WHITE SPOTS

PROJECTION

○: GOOD
△: FAIR
×: POOR

RETURN RATIO 8%

| Iave (μA) \ Ipp(mA) | 5 | 6 | 7 | 8 | 9 | 10 |
|---|---|---|---|---|---|---|
| -76 | | | | △ | | |
| -74 | | | × | △ | | |
| -72 | | × | △ | ○ | | |
| -70 | | × | ○ | ○ | × | |
| -68 | | △ | ○ | ○ | × | |
| -66 | × | △ | ○ | ○ | △ | |
| -64 | △ | ○ | ○ | ○ | △ | |
| -62 | △ | ○ | ○ | ○ | △ | × |
| -60 | ○ | ○ | ○ | ○ | △ | × |
| -58 | ○ | ○ | ○ | ○ | ○ | △ |
| -56 | ○ | ○ | ○ | ○ | ○ | △ |
| -54 | ○ | ○ | ○ | ○ | ○ | △ |
| -52 | ○ | ○ | ○ | ○ | ○ | △ |
| -50 | △ | ○ | ○ | ○ | ○ | △ |
| -48 | △ | ○ | ○ | ○ | ○ | △ |
| -46 | △ | ○ | ○ | ○ | ○ | △ |
| -44 | △ | △ | △ | △ | △ | × |
| -42 | × | × | × | × | × | × |
| -40 | | | | | | |

RECESSED PORTION

WHITE SPOTS

PROJECTION

○: GOOD
△: FAIR
×: POOR

RETURN RATIO 4%

| Iave (μA) \ Ipp(mA) | 5 | 6 | 7 | 8 | 9 | 10 |
|---|---|---|---|---|---|---|
| -76 | | | | | | |
| -74 | | | | | | |
| -72 | | | | | | |
| -70 | | | | | | |
| -68 | | | | | | |
| -66 | | | × | × | | |
| -64 | | | × | △ | | |
| -62 | | | × | △ | × | |
| -60 | | | △ | ○ | △ | |
| RECESSED PORTION | | × | △ | ○ | △ | |
| [illegible] | | × | ○ | ○ | △ | × |
| -54 | | △ | ○ | ○ | ○ | × |
| -52 | | △ | ○ | ○ | ○ | △ |
| -50 | × | ○ | ○ | ○ | ○ | △ |
| -48 | △ | ○ | ○ | ○ | ○ | △ |
| -46 | △ | ○ | ○ | ○ | ○ | △ |
| -44 | △ | △ | △ | △ | △ | × |
| -42 | × | × | × | × | × | × |
| -40 | | PROJECTION | | | | |

WHITE SPOTS

○: GOOD
△: FAIR
×: POOR

RETURN RATIO 32%

| Iave (μA) \ Ipp(mA) | 5 | 6 | 7 | 8 | 9 | 10 |
|---|---|---|---|---|---|---|
| -76 | | | | | | |
| -74 | | | | | | |
| -72 | | | | | | |
| -70 | | | | | | |
| -68 | | × | × | × | | |
| -66 | × | × | △ | × | | |
| [illegible] | × | × | △ | △ | | |
| [illegible] | × | △ | ○ | △ | × | × |
| -60 | △ | △ | ○ | ○ | × | × |
| -58 | △ | ○ | ○ | ○ | × | × |
| -56 | △ | ○ | ○ | ○ | △ | × |
| -54 | ○ | ○ | ○ | ○ | △ | × |
| -52 | ○ | ○ | ○ | ○ | △ | × |
| -50 | △ | ○ | ○ | ○ | ○ | × |
| -48 | △ | ○ | ○ | ○ | ○ | × |
| -46 | △ | ○ | ○ | ○ | ○ | △ |
| -44 | △ | △ | △ | △ | △ | × |
| -42 | × | × | × | × | × | × |
| -40 | | | | | | |

RECESSED PORTION

WHITE SPOTS

PROJECTION

○: GOOD
△: FAIR
×: POOR

RETURN RATIO 16%

| Iave (μA) \ Ipp(mA) | 5 | 6 | 7 | 8 | 9 | 10 |
|---|---|---|---|---|---|---|
| -76 | | | | | | |
| -74 | | | | | | |
| -72 | | | | | | |
| -70 | | | | × | | |
| -68 | | × | × | △ | | |
| -66 | × | × | △ | ○ | × | |
| [illegible] | × | × | △ | ○ | × | |
| [illegible] | × | △ | ○ | ○ | × | × |
| -60 | △ | ○ | ○ | ○ | × | × |
| -58 | △ | ○ | ○ | ○ | △ | × |
| -56 | ○ | ○ | ○ | ○ | △ | × |
| -54 | ○ | ○ | ○ | ○ | △ | × |
| -52 | ○ | ○ | ○ | ○ | ○ | × |
| -50 | △ | ○ | ○ | ○ | ○ | × |
| -48 | △ | ○ | ○ | ○ | ○ | △ |
| -46 | △ | ○ | ○ | ○ | ○ | △ |
| -44 | △ | △ | △ | △ | △ | × |
| -42 | × | × | × | × | × | × |
| -40 | | | | | | |

WHITE SPOTS

RECESSED PORTION

PROJECTION

○: GOOD
△: FAIR
×: POOR

FIG. 21

RETURN RATIO 20%

| Iave (μA) \ Ipp(mA) | 5 | 6 | 7 | 8 | 9 | 10 |
|---|---|---|---|---|---|---|
| -76 | | | | | | |
| -74 | | | × | × | | |
| -72 | | × | △ | × | | |
| -70 | | × | △ | △ | | |
| [illegible] | | △ | ○ | ○ | | |
| [illegible] | × | △ | ○ | ○ | × | |
| -64 | △ | ○ | ○ | ○ | × | |
| -62 | △ | ○ | ○ | ○ | × | × |
| -60 | ○ | ○ | ○ | ○ | △ | × |
| -58 | ○ | ○ | ○ | ○ | △ | × |
| -56 | ○ | ○ | ○ | ○ | ○ | × |
| -54 | ○ | ○ | ○ | ○ | ○ | × |
| -52 | ○ | ○ | ○ | ○ | ○ | △ |
| -50 | △ | ○ | ○ | ○ | ○ | △ |
| -48 | △ | ○ | ○ | ○ | ○ | △ |
| -46 | △ | ○ | ○ | ○ | ○ | △ |
| -44 | △ | △ | △ | △ | △ | × |
| -42 | × | × | × | × | × | × |
| -40 | | | | | | |

RECESSED PORTION

WHITE SPOTS

PROJECTION

○: GOOD
△: FAIR
×: POOR

TRANSFER DEVICE WITH BIAS OUTPUT DEVICE AND IMAGE FORMING APPARATUS INCLUDING SAME

CROSS-REFERENCE TO RELATED APPLICATIONS

This patent application is based on and claims priority pursuant to 35 U.S.C. §119 from Japanese Patent Application Nos. 2011-248575, filed on Nov. 14, 2011, and 2012-157388, filed on Jul. 13, 2012, both in the Japan Patent Office, which are hereby incorporated herein by reference in their entirety.

BACKGROUND OF THE INVENTION

1. Field of the Invention

Exemplary aspects of the present invention generally relate to an image forming apparatus, such as a copier, a facsimile machine, a printer, or a multi-functional system including a combination thereof, and more particularly, to a transfer device employed in the image forming apparatus.

2. Description of the Related Art

Related-art image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image bearing member (which may, for example, be a photoconductive drum); an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

In recent years, a variety of recording media sheets such as paper having a leather-like texture and Japanese paper known as "Washi" have come on the market. Such recording media sheets have a coarse surface acquired through embossing. However, toner does not transfer well to such embossed surfaces of the recording media, in particular, recessed portions of the surface. This inadequate transfer of the toner appears as a pattern of light and dark patches in the resulting output image.

In order to overcome such difficulty, a superimposed bias, in which an alternating current (AC) voltage is superimposed on a direct current (DC) voltage, is supplied as a secondary transfer bias to enhance transferability of toner, as disclosed, for example, in JP-2006-267486-A.

In order to further enhance transferability of toner for recording media sheets having a coarse surface, the surface of the recording medium on which a toner image is transferred is supplied with a positive charge before transfer. During the transfer process, the transfer device is supplied with the superimposed bias as a transfer bias in which an AC voltage is superimposed on a DC voltage.

Although generally effective for its intended purpose, the toner is still not transferred well to the recessed portions of the surface of the recording medium, resulting in image defects such as multiple white spots or dropouts.

In view of the above, there is thus an unsolved need for an image forming apparatus capable of maintaining good toner transferability regardless of the type of recording media sheets.

BRIEF SUMMARY OF THE INVENTION

In view of the foregoing, in an aspect of this disclosure, there is provided an improved transfer device including a rotatable image bearing member, a nip forming member, and a bias output device. The rotatable image bearing member bears a toner image on a surface thereof. The nip forming member contacts the surface of the image bearing member bearing the toner image to form a transfer nip therebetween. The bias output device applies a bias to transfer the toner image on the image bearing member onto a recording medium in the transfer nip. The bias output device outputs a bias current to alternately form a transfer-direction electric field to transfer toner charged with a normal polarity in the toner image to move from the image bearing member to the recording medium and a return-direction electric field to return the toner charged with the normal polarity from the recording medium to the image bearing member. A transition time T1 from a first time at which a current for forming the transfer-direction electric field reaches its maximum (It) to a second time at which a current for forming the return-direction electric field reaches its maximum (Ir) is longer than a transition time T2 from the second time to the first time.

According to another aspect, an improved transfer device includes a rotatable image bearing member, a nip forming member, and a bias output device. The rotatable image bearing member bears a toner image on a surface thereof. The nip forming member contacts the surface of the image bearing member bearing the toner image to form a transfer nip therebetween. The bias output device applies a bias to transfer the toner image on the image bearing member onto a recording medium in the transfer nip. The bias output device outputs a bias current to alternately form a transfer-direction electric field to transfer toner charged with a normal polarity in the toner image to move from the image bearing member to the recording medium and a return-direction electric field to return the toner charged with the normal polarity from the recording medium to the image bearing member. A time T3 during which a current for forming the transfer-direction electric field is applied is longer than a time T4 during which a current for forming the return-direction electric field is applied.

According to another aspect, an improved image forming apparatus includes the transfer device.

According to another aspect, an improved transfer device includes a rotatable image bearing member, a nip forming member, and a bias output device. The rotatable image bearing member bears a toner image on a surface thereof. The nip forming member contacts the surface of the image bearing member bearing the toner image to form a transfer nip therebetween. The bias output device applies a bias to transfer the toner image on the image bearing member onto a recording medium in the transfer nip. The bias output device outputs a bias current to alternately form a transfer-direction electric field to transfer toner charged with a normal polarity in the toner image to move from the image bearing member to the recording medium and a return-direction electric field to return the toner charged with the normal polarity from the recording medium to the image bearing member. A transition time T1 from a first time at which a current for forming the transfer-direction electric field reaches its maximum (It) to a second time at which a current for forming the return-direction electric field reaches its maximum (Ir) is longer than a transition time T2 from the second time to the first time. A time T3 during which a current for forming the transfer-direction electric field is applied is longer than a time T4 during which a current for forming the return-direction electric field is applied The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 21 shows an evaluation of a ninth illustrative embodiment;

DETAILED DESCRIPTION OF DISCLOSED EMBODIMENTS

Figure 1:
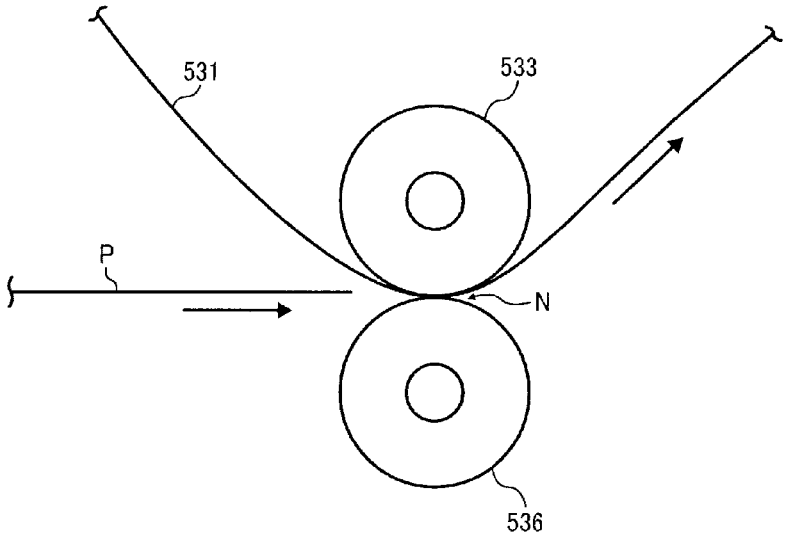
FIG. 1 RELATED ART
FIG. 1 is a schematic diagram illustrating an example of a related-art secondary transfer nip where a secondary transfer back surface roller and a nip forming roller meet and press against each other via an intermediate transfer belt.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Figure 4:
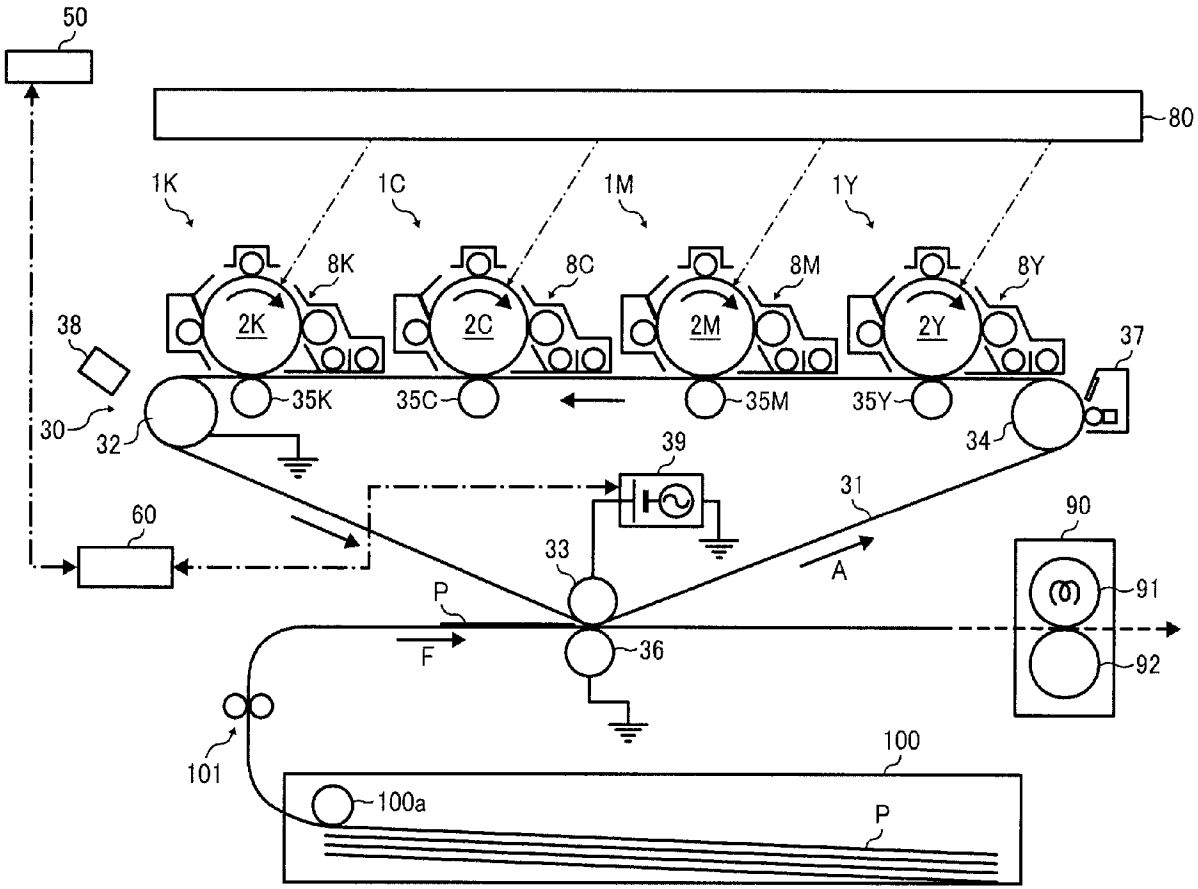
FIG. 4 is a schematic diagram illustrating a color printer as an example of an image forming apparatus according to an illustrative embodiment of the present invention.

Referring now to the drawings, wherein like reference numerals designate identical or corresponding parts throughout the several views, and initially with reference to FIG. 4, a description is provided of an image forming apparatus according to an aspect of this disclosure.

Before going into detail about illustrative embodiments of the present invention, initially, with reference to FIG. 1, a description is provided of a mechanism of generation of toner dropouts or white spots in recessed portions of a surface of a recording medium.

FIG. 1 is a schematic diagram illustrating an example of a related-art secondary transfer nip N where a secondary transfer back surface roller 533 and a nip forming roller 536 meet and press against each other via an intermediate transfer belt 531. More specifically, the secondary transfer back surface roller 533 contacts the rear surface of the intermediate transfer belt 531 and presses the intermediate transfer belt 531 against the nip forming roller 536. Accordingly, the secondary transfer nip N is formed between the peripheral surface or the image bearing surface of the intermediate transfer belt 531 and the nip forming roller 536 contacting the surface of the intermediate transfer belt 531.

In the secondary transfer nip N, a recording medium P tightly contacts a toner image on the intermediate transfer belt 531, and the toner image is transferred secondarily onto the recording medium P due to a secondary transfer bias. The secondary bias for transferring the toner image onto a recording medium is applied to one of the nip forming roller 536 and the secondary transfer back surface roller 533, and the other one of these rollers is grounded.

The toner image can be transferred onto the recording medium P by applying the transfer bias to either the nip forming roller 536 or the secondary transfer back surface roller 533. Herein, a description is provided of application of the secondary transfer bias to the secondary transfer back surface roller 533 when using toner having a negative polarity. In this case, in order to move the toner in the secondary transfer nip N from the secondary transfer back surface roller side to the nip forming roller side, a superimposed bias is applied as the secondary transfer bias. More specifically, a time-averaged electrical potential of the secondary transfer bias has a negative polarity which is the same polarity as the toner.

Figure 2:
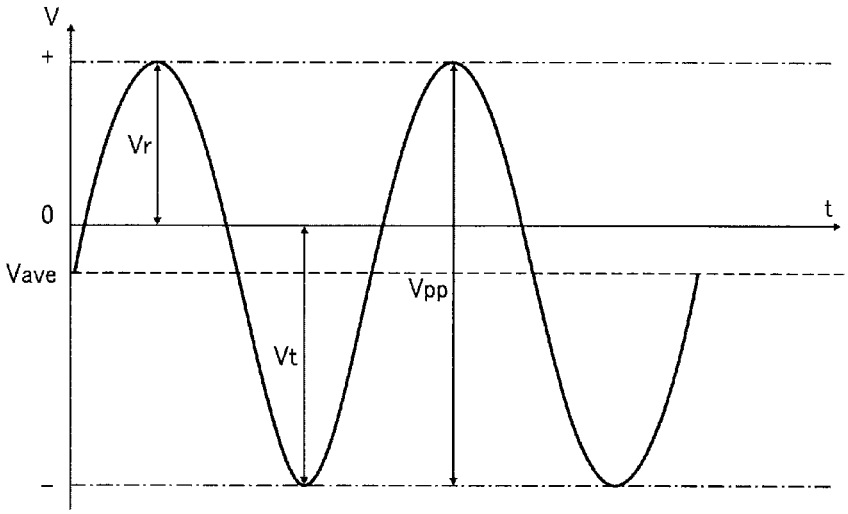
FIG. 2 RELATED ART
FIG. 2 is a waveform chart showing an example of a waveform of a superimposed bias serving as a transfer bias applied to the secondary transfer back surface roller of FIG. 1.

With reference to FIG. 2, a description is provided of the secondary transfer bias using the superimposed bias applied to the secondary transfer back surface roller 533. FIG. 2 is a waveform chart showing an example of a waveform of the superimposed bias as the secondary transfer bias. In FIG. 2, an offset voltage Vave [V] is a time-averaged value of the secondary transfer bias. In this example, the superimposed bias as the secondary transfer bias has a sinusoidal waveform which includes a peak at a positive side and a peak at a negative side.

In FIG. 2, a reference sign Vt refers to one of the two peak values, that is, the peak value for moving the toner in the secondary transfer nip N from the belt side to the recording medium side, i.e. the negative peak value in the present example (hereinafter referred to as a transfer peak value Vt). A reference sign Vr refers to the other peak value, that is, the peak value for returning the toner from the recording medium side to the belt side, i.e. the positive peak value in the present example (hereinafter referred to as a returning peak value Vr).

Even when an alternating current (AC) bias including only an AC component is applied, it is possible to move the toner back and forth between the intermediate transfer belt 531 and the recording medium P in the secondary transfer nip N. However, the AC bias simply moves the toner back and forth between the intermediate transfer belt 531 and the recording medium P, but does not transfer the toner onto the recording medium. If a superimposed bias including a DC component is applied to adjust the offset voltage Vave [V], that is, the time-averaged value of the superimposed bias, to the same negative polarity as the toner, it is possible to enable the toner to relatively move from the belt side toward the recording medium P while the toner moves back and forth between the belt side and the recording medium side. Accordingly, the toner can be transferred onto the recording medium P.

According to experiments performed by the present inventors, when the secondary transfer bias including a superimposed bias starts being applied, only a very small number of toner particles on the surface of a toner layer on the intermediate transfer belt 531 first separates from the toner layer and moves toward recessed portions of the surface of the recording medium P. However, most of the toner particles in the toner layer remain therein. The very small number of toner particles separated from the toner layer enters the recessed portions of the surface of the recording medium P.

Subsequently, if the direction of the electric field is reversed, the toner particles return from the recessed portions to the toner layer. When this happens, the toner particles returning to the toner layer strike the toner particles remaining in the toner layer so that adhesion of the toner particles to the toner layer (or to the recording medium P) is weakened. As a result, when the polarity of the electric field reverses towards the direction of the recording medium, more toner particles than in the initial time separate from the toner layer and move to the recessed portions of the recording medium P.

As this process is repeated, the amount of toner particles separating from the toner layer and entering the recessed portions of the recording medium is increased gradually. Consequently, a sufficient amount of toner particles is transferred to the recessed portions of the recording medium P.

In this configuration, however, the level of the returning peak value Vr needs to be relatively high. Otherwise, the toner particles once entered in the recessed portions of the recording medium surface cannot be returned adequately to the toner layer on the intermediate transfer belt, resulting in a deficiency in image density in the recessed portions. Furthermore, the level of the offset voltage (time-averaged voltage) Vave [V] needs to be relatively high. Otherwise, an amount of toner transferred onto projecting portions of the recording medium is insufficient, resulting in a deficiency in image density in the projecting portions.

In order to obtain sufficient image density in both the projecting and the recessed portions of the recording medium surface, a peak-to-peak voltage Vpp needs to be relatively high so as to make the offset voltage Vave [V] and the returning peak value Vr relatively high. Accordingly, the transfer peak value Vt is also relatively high. The transfer peak value Vt corresponds to the maximum potential difference between the nip forming roller 536 being grounded and the secondary transfer back surface roller 533. Hence, when the transfer peak value Vt becomes high, electrical discharge tends to occur easily between the rollers.

More specifically, electrical discharge occurs between a slight gap between the belt surface and the recessed portions of the recording medium surface, causing dropouts or white spots in the image formed on the recessed portions of the recording medium surface. It is known that image defects such as dropouts or white spots tend to occur easily in the image formed on the recessed portions of the recording medium surface because the peak-to-peak voltage Vpp is relatively high to obtain sufficient image density in the projecting portions and the recessed portions of the recording medium surface.

In order to prevent improper transfer of toner, that is, dropouts or white spots in the recessed portions of the recording medium surface, according to a first illustrative embodiment of the present invention, the AC component of the transfer bias is applied such that a transfer-direction electric field for causing toner charged with a normal polarity in a toner image to move from the image bearing member to the recording medium P and a return-direction electric field for returning toner from the recording medium P to the image bearing member are formed. Further, a time T1 is longer than a time T2 (shown in FIG. 3A), where T1 is a transition time from a time at which a current for forming the transfer-direction electric field reaches its maximum (It) to a time at which a current for forming the return-direction electric field reaches its maximum (Ir), and T2 is a transition time from Ir to It. With this configuration, improper transfer of toner such as dropouts is prevented while obtaining sufficient image density on the embossed surface including projecting portions and the recessed portions of the recording medium, as compared with having the same transition time from "It" to "Ir" and from "Ir" to "It".

It is to be noted that in this specification the current for forming an electric field for causing toner to move from the image bearing member to the recording medium P is referred to as a transfer-direction current while referring the current for forming an electric field for returning toner from the recording medium P to the image bearing member as a return-direction current. The return-direction current has a polarity opposite that of the transfer-direction current.

According to a second illustrative embodiment of the present invention, the AC component of the transfer bias is applied such that the transfer-direction electric field for causing toner in a toner image to move from the image bearing member to the recording medium P and the return-direction electric field for returning toner from the recording medium P to the image bearing member are formed. Further, a time T3 is longer than a time T4 (shown in FIG. 3B), where T3 is a time during which the transfer-direction current is applied and T4 is a time during which the return-direction current is applied. With this configuration, improper transfer of toner such as dropouts is prevented while obtaining sufficient image density on the embossed surface including projecting portions and the recessed portions of the recording medium, as compared with the time during which the transfer-direction current is applied equals the time during which the return-direction current is applied.

When transferring toner to a recording medium having a coarse surface such as an embossed surface, the transferability depends on the offset voltage (time-averaged voltage) Vave or the time-averaged current (offset current) lave, but does not depend on the transfer peak value Vt. However, the transferability upon transferring toner to the recessed portions of the recording medium drops significantly unless the level of the returning peak value Vr is equal to or greater than a predetermined threshold value. In a case in which the level of the returning peak value Vr is equal to or greater than a predetermined threshold value, the transferability also depends on the level of the time-averaged current (offset current) lave, similar to the projecting portions of the recording medium.

In order to transfer toner properly onto the recording medium having a coarse surface, a minimum required level of Vr and a sufficient Vave are needed. In a case in which a sinusoidal waveform or a symmetric rectangular waveform in which the time T1 equals the time T2, and the time during which a normal transfer-direction current is applied is equal to the time during which the return-direction current is applied, when lave and Vr are determined, the given level of Vt is high. As a result, improper transfer of toner occurs.

In view of the above, according to the first illustrative embodiment, employing a waveform in which T1 is longer than T2 (T1>T2) can maintain effectively a sufficient amount of time for forming the transfer-direction electric field so that the necessary Vr and the sufficient lave are obtained while maintaining Vt low.

According to the second illustrative embodiment, employing a waveform in which the time T3 is longer than the time T4 (T3>T4) can obtain effectively the sufficient amount of time for forming the transfer-direction electric field so that the necessary Vr and the sufficient lave are obtained while maintaining Vt low.

Figure 3A:
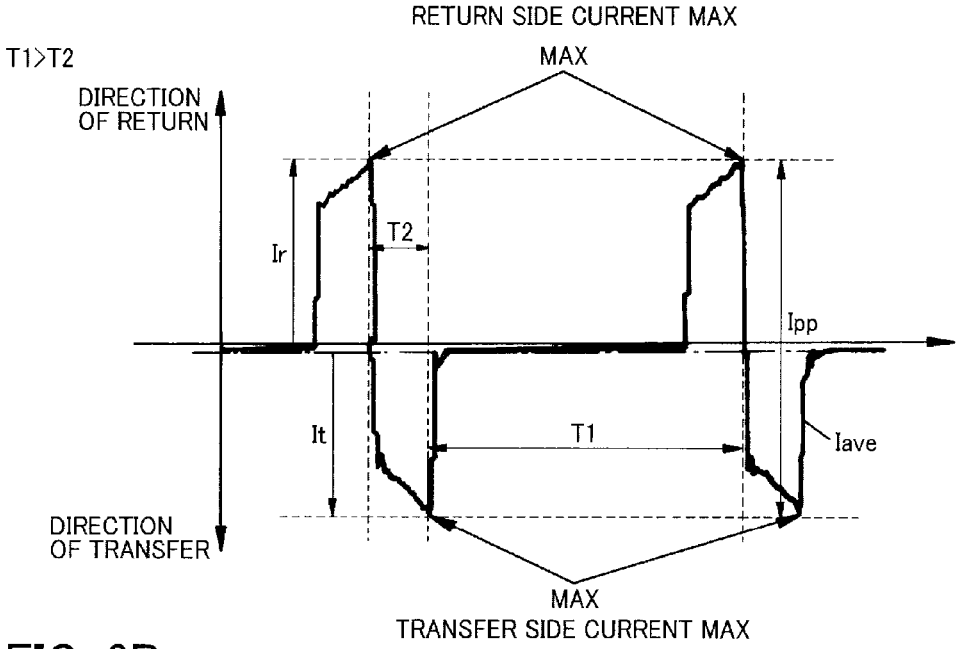
FIG. 3A is a waveform chart showing an example of a waveform of a superimposed bias serving as a transfer bias according to a first illustrative embodiment of the present invention.
Figure 3B:
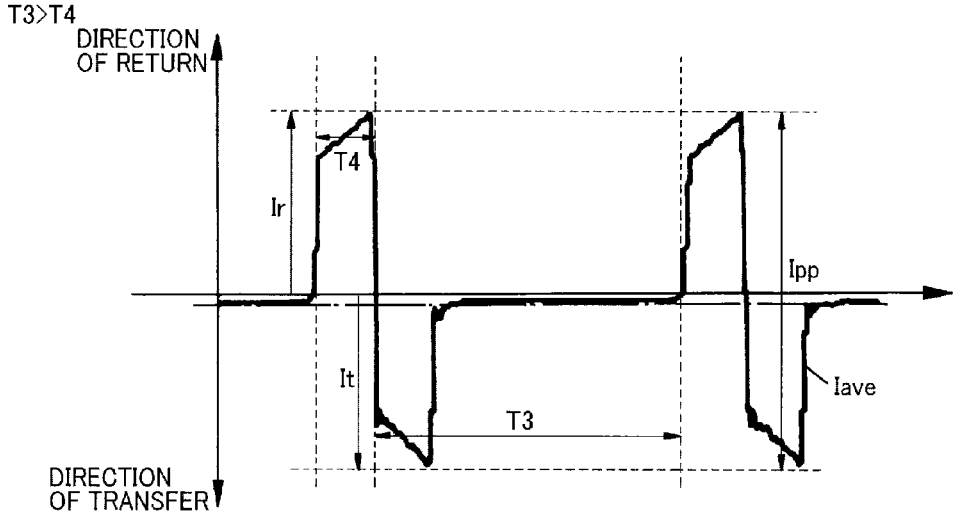
FIG. 3B is a waveform chart showing an example of a waveform of the superimposed bias according to a second illustrative embodiment of the present invention.

FIG. 3A shows an example of the waveform of the transfer bias of the first illustrative embodiment in which the time T1 during which It becomes Ir is longer than the time T2 during which Ir becomes It. FIG. 3B is an example of the waveform of the transfer bias of the second illustrative embodiment in which the time T3 during which the transfer-direction current is applied is longer than the time T4 during which the return-direction current is applied. Using the transfer bias having such waveforms, the necessary Vr and the sufficient lave are obtained while maintaining Vt low.

With reference to FIG. 4, a description is provided of the image forming apparatus according to the illustrative embodiment of the present invention. It is to be noted that the mechanical configurations of the image forming apparatus of the first and the second illustrative embodiment are same.

FIG. 4 is a schematic diagram illustrating a color printer as an example of the image forming apparatus. The image forming apparatus shown in FIG. 4 employs an intermediate transfer method in which a toner image formed on an image bearing member is indirectly transferred onto a recording medium via an intermediate transfer member.

According to the present illustrative embodiment, an intermediate transfer belt 31 serves as the intermediate transfer member disposed substantially in the center of the image forming apparatus. As illustrated in FIG. 4, the image forming apparatus includes four image forming units 1Y, 1M, 1C, and 1K (which may be collectively referred to as image forming units 1), an optical writing unit 80, a transfer unit 30 including the intermediate transfer belt 31, a fixing device 90, and so forth. Substantially above the intermediate transfer belt 31, the image forming units 1Y, 1M, 1C, and 1K, one for each of the colors yellow, magenta, cyan, and black, are arranged in tandem in the direction of movement of the intermediate transfer belt 31 indicated by a hollow arrow A, thereby constituting a tandem imaging station.

It is to be noted that suffixes Y, M, C, and K denote the colors yellow, magenta, cyan, and black, respectively. To simplify the description, these suffixes Y, M, C, and K indicating colors are omitted herein unless otherwise specified. According to the illustrative embodiment, the image forming units 1Y, 1M, 1C, and 1K are detachably attachable relative to the image forming apparatus main body.

Figure 5:
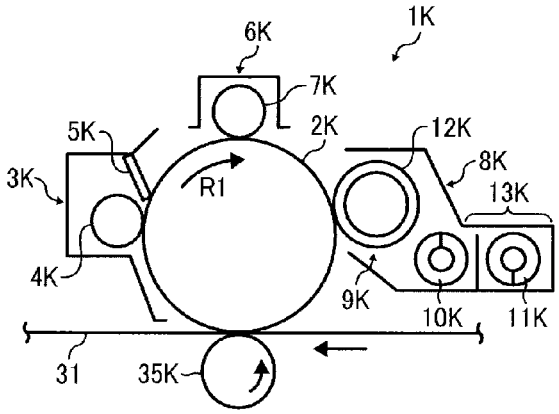
FIG. 5 is a schematic diagram illustrating an image forming unit employed in the image forming apparatus of FIG. 4.

With reference to FIG. 5, a description is provided of the image forming units 1Y, 1M, 1C, and 1K. It is to be noted that the image forming units 1Y, 1M, 1C, and 1K all have the same configurations as all the others, differing only in the color of toner employed. Thus, a description is provided of the image forming unit 1K as an example of the image forming units.

FIG. 5 is a schematic diagram illustrating the image forming unit 1K. As illustrated in FIG. 5, the image forming unit 1K includes a drum-shaped photosensitive member (hereinafter referred to simply as photosensitive drum) 2K, a charging device 6K, a developing device 8K, a primary transfer roller 35K, a cleaning device 3K, and so forth. The charging device 6K charges the surface of the photosensitive drum 2K by using a charging roller 7K. The developing device 8K develops a latent image formed on the photosensitive drum 2K with a respective color of toner to form a visible image known as a toner image. The primary transfer roller 35K serving as a primary transfer member transfers the toner image from the photosensitive drum 2K to the intermediate transfer belt 31. The cleaning device 3K cleans the surface of the photosensitive drum 2K after primary transfer.

The photosensitive drum 2K is constituted of a drum-shaped base on which an organic photosensitive layer is disposed. The photosensitive drum 2K is rotated in a clockwise direction indicated by an arrow R1 by a driving device, not illustrated. The charging roller 7K of the charging device 6K is supplied with a charging bias. The charging roller 7K contacts or is disposed close to the photosensitive drum 2K to generate an electrical discharge therebetween, thereby charging uniformly the surface of the photosensitive drum 2K.

According to the present illustrative embodiment, the photosensitive drum 2K is uniformly charged with a negative polarity which is the same polarity as the normal charge on toner. More specifically, the photosensitive drum 2K is charged uniformly at approximately −650 V. As the charging bias, an AC voltage superimposed on a DC voltage is employed. The charging roller 7K is formed of a metal cored bar covered with a conductive elastic layer made of conductive elastic material. Instead of using the charging roller or the like that contacts or disposed close to the photoconductive drum 2K, a corona charger or the like that does not contact the photoconductive drum 2K may be employed.

A description of the developing device 8 is provided later. According to the present illustrative embodiment, a two-component developing agent is used. Alternatively, a single-component developing agent may be used.

The cleaning device 3 removes residual toner remaining on the surface of the photosensitive drum 2K after primary transfer. According to the present illustrative embodiment, the cleaning device 3K includes a cleaning blade 5K and a cleaning brush 4K. The cleaning blade 5K of the cleaning device 3K contacts the surface of the photosensitive drum 2K at a certain angle such that the leading edge of the cleaning blade 5K faces counter to the direction of rotation R1 of the photosensitive drum 2K. The cleaning brush 4K rotates in the direction opposite to the direction of rotation R1 of the photosensitive drum 2K while contacting the photosensitive drum 2K, thereby cleaning the surface of the photosensitive drum 2K.

A charge neutralizing device removes residual charge remaining on the photosensitive drum 2K after the surface thereof is cleaned by the cleaning device 3K so that the surface of the photosensitive drum 2K is initialized in preparation for the subsequent imaging cycle.

Referring back to FIG. 4, a description is provided of the optical writing unit 80. The optical writing unit 80 for writing a latent image on each of the photosensitive drums 2Y, 2M, 2C, and 2K (which may be collectively referred to as photosensitive drums 2) is disposed above the image forming units 1Y, 1M, 1C, and 1K. Based on image information received from external devices such as a personal computer (PC), the optical writing unit 80 illuminates the photosensitive drums 2Y, 2M, 2C, and 2K with a light beam projected from a light source such as a laser diode of the optical writing unit 80. Accordingly, the electrostatic latent images of yellow, magenta, cyan, and black are formed on the photosensitive drums 2Y, 2M, 2C, and 2K, respectively.

More specifically, the potential of a portion of the uniformly-charged surface of the photosensitive drums 2 illuminated with the light beam is attenuated. The potential of the illuminated portion of the photosensitive drum 2 with the light beam is less than the potential of the other area, that is, a background portion (non-image formation area), thereby forming an electrostatic latent image on the surface of the photosensitive drum 2. The optical writing unit 80 includes a polygon mirror, a plurality of optical lenses, and mirrors. The light beam projected from the light source is deflected in a main scanning direction by the polygon mirror rotated by a polygon motor. The deflected light, then, strikes the optical lenses and mirrors, thereby scanning the photosensitive drum 2. Alternatively, the optical writing unit 80 may employ a light source using an LED array including a plurality of LEDs that projects light.

Still referring to FIG. 1, a description is provided of the transfer unit 30. The transfer unit 30 is disposed below the image forming units 1Y, 1M, 1C, and 1K. The transfer unit 30 includes the intermediate transfer belt 31 serving as an image bearing member formed into an endless loop and entrained about a plurality of rollers, thereby rotating endlessly in the counterclockwise direction indicated by arrow A. The transfer unit 30 also includes a driving roller 32, a secondary transfer back surface roller 33, a cleaning auxiliary roller 34, four primary transfer rollers 35Y, 35M, 35C, and 35K (which may be referred to collectively as primary transfer rollers 35), a nip forming roller 36, a belt cleaning device 37, an voltage detector 38, and so forth. The primary transfer rollers 35Y, 35M, 35C, and 35K are disposed opposite the photosensitive drums 2Y, 2M, 2C, and 2K, respectively, via the intermediate transfer belt 31.

The intermediate transfer belt 31 is entrained around and stretched taut between the driving roller 32, the secondary transfer back surface roller 33, the cleaning auxiliary roller 34, and the primary transfer rollers 35, all disposed inside the loop formed by the intermediate transfer belt 31. The driving roller 32 is rotated by a driving device (not illustrated), enabling the intermediate transfer belt 31 to move in the direction of arrow A.

The surface resistivity of the intermediate transfer belt 31 is in a range of from approximately 9.0 [Log Ω/cm$^2$] to approximately 13.0 [Log Ω/cm$^2$], preferably, approximately 10.0 [Log Ω/cm$^2$] to approximately 12.0 [Log Ω/cm$^2$]. The surface resistivity is measured with an applied voltage of 500V by HIRESTA UPMCPHT 45 manufactured by Mitsubishi Chemical Corporation with an HRS probe. The volume resistivity is obtained after 10 seconds elapses. The volume resistivity thereof is in a range of from approximately 6.0 [Log Ω·cm] to approximately 13 [Log Ω·cm], preferably, in a range of from approximately 7.5 [Log Ω·cm] to approximately 13 [Log Ω·cm]. The volume resistivity is measured with an applied voltage of 100V by the high resistivity meter, HIRESTA UPMCPHT 45 with the HRS probe manufactured by Mitsubishi Chemical Corporation. The volume resistivity is obtained after 10 seconds elapses.

The intermediate transfer belt 31 is interposed between the photosensitive drums 2 and the primary transfer rollers 35. Accordingly, primary transfer nips are formed between the front surface (image bearing surface) of the intermediate transfer belt 31 and the photosensitive drums 2Y, 2M, 2C, and 2K contacting the intermediate transfer belt 31. A primary transfer bias is applied to the primary transfer rollers 35 by a transfer bias power source, thereby forming a transfer electric field between the toner images on the photosensitive drums 2 and the primary transfer rollers 35. Accordingly, the toner images are transferred primarily from the photosensitive drums 2 onto the intermediate transfer belt 31 due to the transfer electric field and nip pressure at the primary transfer nips.

More specifically, the toner images of yellow, magenta, cyan, and black are transferred primarily onto the intermediate transfer belt 31 so that they are superimposed one atop the other, thereby forming a composite toner image.

In the case of forming a monochrome image, a support plate supporting the primary transfer rollers 35Y, 35M, and 35C of the transfer unit 30 is moved to separate the primary transfer rollers 35Y, 35M, and 35C from the photosensitive drums 2Y, 2M, and 2C. Accordingly, the front surface of the intermediate transfer belt 31, that is, the image bearing surface, is separated from the photosensitive drums 2Y, 2M, and 2C so that the intermediate transfer belt 31 contacts only the photosensitive drum 2K. In this state, only the image forming unit 1K is operated to form a toner image of black on the photosensitive drum 2K.

Each of the primary transfer rollers 35 comprises an elastic roller including a metal cored bar on which a conductive sponge layer is fixated. The shaft center of each of the shafts of the primary transfer rollers 35 is approximately 2.5 mm off from the shaft center of each of the shafts of the photosensitive drums 2 toward the downstream side in the direction of movement of the intermediate transfer belt 31. The primary transfer rollers 35 described above are supplied with a constant-current controlled primary transfer bias.

According to the illustrative embodiment described above, a roller-type transfer device (here, the primary transfer rollers 35) is used as a primary transfer device. Alternatively, a transfer charger or a brush-type transfer device may be employed as a primary transfer device.

As illustrated in FIG. 1, the nip forming roller 36 of the transfer unit 30 is disposed outside the loop formed by the intermediate transfer belt 31, opposite the secondary transfer back surface roller 33 which is disposed inside the loop. The intermediate transfer belt 31 is interposed between the secondary transfer back surface roller 33 and the nip forming roller 36. Accordingly, a secondary transfer nip is formed between the peripheral surface or the image bearing surface of the intermediate transfer belt 31 and the nip forming roller 36 contacting the surface of the intermediate transfer belt 31.

The nip forming roller 36 is grounded; by contrast, a secondary transfer bias is applied to the secondary transfer back surface roller 33 by a secondary transfer bias power source 39 serving as a bias output device. With this configuration, a secondary transfer electric field is formed between the secondary transfer back surface roller 33 and the nip forming roller 36 so that the toner moves electrostatically from the secondary transfer back surface roller side to the nip forming roller side.

As illustrated in FIG. 4, a sheet cassette 100 storing a stack of recording media sheets P is disposed below the transfer unit 30. The sheet cassette 100 is equipped with a sheet feed roller 100*a* to contact a top sheet of the stack of recording media sheets P. As the sheet feed roller 100*a* is rotated at a predetermined speed, the sheet feed roller 100*a* picks up the top sheet and feeds it to a sheet passage in the image forming apparatus.

Substantially at the end of the sheet passage, a pair of registration rollers 101 is disposed. The pair of registration rollers 101 stops rotating temporarily, immediately after the recording medium P delivered from the sheet cassette 100 is interposed therebetween. The pair of registration rollers 101 starts to rotate again to feed the recording medium P to the secondary transfer nip in appropriate timing such that the recording medium P is aligned with a composite or monochrome toner image formed on the intermediate transfer belt 31 in the secondary transfer nip.

In the secondary transfer nip, the recording medium P tightly contacts the composite or the monochrome toner image on the intermediate transfer belt 31, and the composite or the monochrome toner image is transferred secondarily onto the recording medium P due to the secondary transfer electric field and the nip pressure applied thereto. After the recording medium P on which the composite or monochrome toner image is transferred passes through the secondary transfer nip, the recording medium P separates from the nip forming roller 36 and the intermediate transfer belt 31 due to the curvature of the nip forming roller 36, also known as self stripping.

The secondary transfer back surface roller 33 is formed of a metal cored bar on which a conductive nitrile rubber (NBR) layer is disposed. The nip forming roller 36 is formed of a metal cored bar on which the NBR rubber layer is disposed. The volume resistivity of the secondary transfer back surface roller 33 is in a range of from approximately 6.0 to approximately 8.0 [Log Ωcm]. The volume resistivity of the secondary transfer back surface roller 33 is measured with a weight of 5 N at one side while applying a bias of 1 kV to the shaft of the transfer roller using the rotation measurement method in which the volume resistivity is measured while the roller makes one rotation in one minute.

The voltage detector 38 is disposed outside the loop formed by the intermediate transfer belt 31, opposite the driving roller 32 which is grounded. More specifically, the voltage detector 38 faces a portion of the intermediate transfer belt 31 entrained around the driving roller 32 with a gap of approximately 4 mm. The surface potential of the toner image primarily transferred onto the intermediate transfer belt 31 is measured when the toner image comes to the position opposite the voltage detector 38. In the present illustrative embodiment, a surface potential sensor EFS-22D manufactured by TDK Corp. is employed as the voltage detector 38.

The fixing device 90 is disposed on the right hand side of the secondary transfer nip between the secondary transfer back surface roller 33 and the intermediate transfer belt 31. The fixing device 90 includes a fixing roller 91 and a pressing roller 92. The fixing roller 91 includes a heat source such as a halogen lamp inside thereof. While rotating, the pressing roller 92 pressingly contacts the fixing roller 91, thereby forming a heated area called a fixing nip therebetween. The recording medium P bearing an unfixed toner image on the surface thereof is conveyed to the fixing device 90 and interposed between the fixing roller 91 and the pressing roller 92 in the fixing device 90. Under heat and pressure, the toner adhered to the toner image is softened and fixed to the recording medium P in the fixing nip. Subsequently, the recording medium P is discharged outside the image forming apparatus from the fixing device 90 along the sheet passage after fixing.

According to the present illustrative embodiment, a process linear velocity in a normal mode, that is, a linear velocity of the photosensitive drum and the intermediate transfer belt, is approximately 280 mm/s. It is to be noted that the process linear velocity in a high quality image mode in which priority is given to image quality over the printing speed is slower than that in the normal mode. By contrast, the process linear velocity in a high speed mode in which priority is given to the printing speed over the image quality is faster than that in the normal mode. Switching between the normal mode, the high quality image mode, and the high speed mode is performed through a key operation by a user on a control panel 50, serving as a user interface, or a printer property menu of a personal computer.

According to the present illustrative embodiment, the secondary transfer bias power source 39 serving as a secondary transfer bias output device includes a direct current (DC) power source and an alternating current (AC) power source, and can output a DC voltage (hereinafter referred to as DC bias) or a superimposed bias as the secondary transfer bias. The superimposed bias includes an AC voltage superimposed on a DC voltage.

According to the present illustrative embodiment shown in FIG. 4, the nip forming roller 36 is grounded while the superimposed bias is applied to the secondary transfer back surface roller 33. Alternatively, the secondary transfer back surface roller 33 may be grounded while the superimposed bias is supplied to the nip forming roller 36. More specifically, as illustrated in FIG. 4, in a case in which the superimposed bias is applied to the secondary transfer back surface roller 33 while toner having a negative polarity is used and the nip forming roller 36 is grounded, the DC voltage having the same negative polarity as the toner is used so that the time-averaged potential of the superimposed bias has the same negative polarity as that of the toner.

By contrast, in a case in which the secondary transfer back surface roller 33 is grounded and the superimposed bias is applied to the nip forming roller 36, the DC voltage having the positive polarity opposite that of the toner is used so that the time-averaged potential of the superimposed bias has the positive polarity opposite that of the toner. Instead of applying the superimposed bias to the secondary transfer back surface roller 33 or to the nip forming roller 36, the DC voltage may be supplied to one of the secondary transfer back surface roller 33 and the nip forming roller 36, and the AC voltage may be supplied to the other roller.

When using a normal sheet of paper, such as the one having a relatively smooth surface, a pattern of dark and light according to the surface conditions of the sheet is less likely to appear on the resulting image formed on the recording medium. In this case, the transfer bias consisting only of the DC voltage is applied. By contrast, when using a recording medium having a coarse surface such as pulp paper and embossed paper, the transfer bias needs to be changed from the transfer bias consisting only of the DC voltage to the superimposed bias.

After the intermediate transfer belt 31 passes through the secondary transfer nip, residual toner not having been transferred onto the recording medium P remains on the intermediate transfer belt 31. The residual toner is removed from the intermediate transfer belt 31 by the belt cleaning device 37 which contacts the surface of the intermediate transfer belt 31. The cleaning auxiliary roller 34 disposed inside the loop formed by the intermediate transfer belt 31 supports cleaning operation by the belt cleaning device 37 from inside the loop of the intermediate transfer belt 31 so that the residual toner on the intermediate transfer belt 31 is removed reliably.

As described above, the secondary transfer bias power source 39 outputs a superimposed bias including a DC component and an AC component as a secondary transfer bias. According to the present illustrative embodiment, the DC component of the superimposed bias has the same value as the time-averaged voltage Vave which is the voltage having the DC component.

In the image forming apparatus of the illustrative embodiment in which the secondary transfer bias is applied to the secondary transfer back surface roller 33 and the nip forming roller 36 is grounded, if the polarity of the superimposed bias is negative so is the polarity of the toner, the toner having the negative polarity is moved electrostatically from the secondary transfer back surface roller side to the nip forming roller side in the secondary transfer nip. Accordingly, the toner on the intermediate transfer belt 31 is transferred onto the recording medium P.

By contrast, if the polarity of the superimposed bias has a polarity opposite that of the toner, that is, the polarity of the superimposed bias is positive, the toner having a negative polarity is attracted electrostatically to the secondary transfer back surface roller side from the nip forming roller side. Consequently, the toner transferred to the recording medium P is attracted again to the intermediate transfer belt 31.

Next, with reference to FIGS. 6 through 9, a description is provided of behavior of toner.

Figure 6:
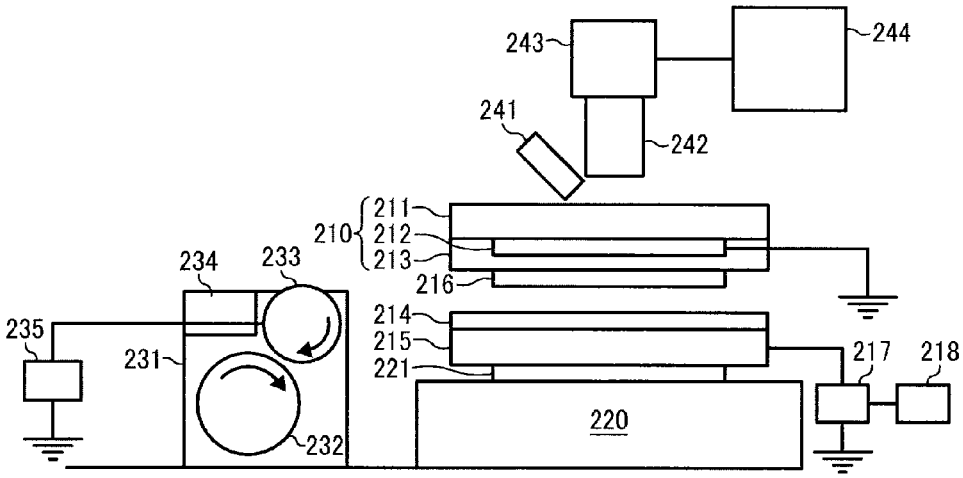
FIG. 6 is a schematic diagram illustrating experiment equipment for observation of behavior of toner in a secondary transfer nip.

The present inventors performed experiments using special observation equipment 200 shown in FIG. 6. FIG. 6 is a schematic diagram illustrating the observation equipment 200 for observation of behavior of toner in the secondary transfer nip. The observation equipment 200 includes a transparent substrate 210, a metal plate 215, a substrate 221, a development device 231, a power supply 235, a Z stage 220, a light source 241, a microscope 242, a high-speed camera 243, a personal computer 244, a voltage amplifier 217, a waveform generator 218, and so forth.

The transparent substrate 210 includes a glass plate 211, a transparent electrode 212 made of Indium Tin Oxide (ITO) and disposed on a lower surface of the glass plate 211, and a transparent insulating layer 213 made of a transparent material covering the transparent electrode 212. The transparent substrate 210 is supported at a predetermined height position by a substrate support. The substrate support is allowed to move in the vertical and horizontal directions in the drawing by a moving assembly. In the illustrated example shown in FIG. 6, the transparent substrate 210 is located above the Z stage 220 having the metal plate 215 placed thereon. The transparent substrate 210 is capable of moving to a position directly above the development device 231 disposed lateral to the Z stage 220, in accordance with the movement of the substrate support. The transparent electrode 212 of the transparent substrate 210 is connected to a grounded electrode fixed to the substrate support.

The development device 231 is similar in configuration to the development device 8K illustrated in FIG. 5 according to the illustrative embodiment, and includes a screw 232, a development roll 233, a doctor blade 234, and so forth. The development roll 233 is driven to rotate with a development bias applied thereto by the power supply 235.

In accordance with the movement of the substrate support, the transparent substrate 210 is moved at a predetermined speed to a position directly above the development device 231 and disposed opposite the development roll 233 with a predetermined gap therebetween. Then, toner on the development roll 233 is transferred to the transparent electrode 212 of the transparent substrate 210. Thereby, a toner layer 216 having a predetermined thickness is formed on the transparent electrode 212 of the transparent substrate 210. The toner adhesion amount per unit area in the toner layer 216 is adjustable by the toner density in the developing agent, the toner charge amount, the development bias value, the gap between the transparent substrate 210 and the development roll 233, the moving speed of the transparent substrate 210, the rotation speed of the development roll 233, and so forth.

The transparent substrate 210 formed with the toner layer 216 is translated to a position opposite a recording medium 214 adhered to the planar metal plate 215 by a conductive adhesive. The metal plate 215 is placed on the substrate 221, which is provided with a load sensor and placed on the Z stage 220. Further, the metal plate 215 is connected to the voltage amplifier 217. The waveform generator 218 provides the voltage amplifier 217 with a transfer bias including a DC voltage and an AC voltage.

The transfer bias is amplified by the voltage amplifier 217 and applied to the metal plate 215. If the Z stage 220 is drive-controlled and elevates the metal plate 215, the recording medium 214 starts coming into contact with the toner layer 216. If the metal plate 215 is further elevated, the pressure applied to the toner layer 216 increases. The elevation of the metal plate 215 is stopped when the output from the load sensor reaches a predetermined value.

With the pressure maintained at the predetermined value, a transfer bias is applied to the metal plate 215, and the behavior of the toner is observed. After the observation, the Z stage 220 is drive-controlled to lower the metal plate 215 and separate the recording medium 214 from the transparent substrate 210. Thereby, the toner layer 216 is transferred onto the recording medium 214.

The behavior of the toner is examined using the microscope 242 and the high-speed camera 243 disposed above the transparent substrate 210. The transparent substrate 210 is formed of the layers of the glass plate 211, the transparent electrode 212, and the transparent insulating layer 213, which are all made of transparent material. It is therefore possible to observe, from above and through the transparent substrate 210, the behavior of the toner located under the transparent substrate 210.

In the present experiment, a microscope using a zoom lens VH-Z75 manufactured by Keyence Corporation was used as the microscope 242. Further, a camera FASTCAM-MAX 120KC manufactured by Photron Limited was used as the high-speed camera 243 controlled by the personal computer 244. The microscope 242 and the high-speed camera 243 are supported by a camera support. The camera support adjusts the focus of the microscope 242.

The behavior of the toner on the transparent substrate 210 was photographed as follows. That is, the position at which the behavior of the toner is observed was illuminated with light by the light source 241, and the focus of the microscope 242 was adjusted. Then, a transfer bias was applied to the metal plate 215 to move the toner in the toner layer 216 adhering to the lower surface of the transparent substrate 210 toward the recording medium 214. The behavior of the toner in this process was photographed by the high-speed camera 243.

The structure of the transfer nip in which toner is transferred onto a recording medium is different between the observation experiment equipment 200 illustrated in FIG. 6 and the image forming apparatus of the illustrative embodiment. Therefore, the transfer electric field acting on the toner is different therebetween, even if the applied transfer bias is the same.

To find appropriate observation conditions, transfer bias conditions allowing the observation experiment equipment 200 to attain favorable density reproducibility on recessed portions of a surface of a recording medium were investigated. As the recording sheet 214, a sheet of FC Japanese paper SAZANAMI manufactured by NBS Ricoh Company, Ltd. was used. As the toner, yellow (Y) toner having an average toner particle diameter of approximately 6.8 μm mixed with a relatively small amount of black (K) toner was used.

The observation experiment equipment 200 was configured to apply the transfer bias to a rear surface of the recording sheet 214 (i.e., SAZANAMI). Therefore, in the observation experiment equipment 200, the polarity of the transfer bias capable of transferring the toner onto the recording sheet 214 was the opposite of the polarity of the transfer bias employed in the image forming apparatus according to the illustrative embodiment (i.e., positive polarity). As the AC component of the transfer bias including a superimposed bias, an AC component having a sinusoidal waveform was employed. A frequency f of the AC component was set to approximately 1,000 Hz.

Further, the DC component was set to approximately 200 V, and a peak-to-peak voltage Vpp was set to approximately 1,000 V. The toner layer 216 was transferred onto the recording sheet 214 with a toner adhesion amount in a range of from approximately 0.4 mg/cm$^2$ to approximately 0.5 mg/cm$^2$. As a result, a sufficient image density was successfully obtained on the recessed portions of the surface of the SAZANAMI paper sheet.

Under the above-described conditions, the behavior of the toner was photographed with the microscope 242 focused on the toner layer 216 on the transparent substrate 210, and the following phenomenon was observed. That is, the toner particles in the toner layer 216 moved back and forth between the transparent substrate 210 and the recording sheet 214 due to an alternating electric field generated by the AC component of the transfer bias. With an increase in the number of the back-and-forth movements, the amount of toner particles moving back and forth was increased.

Figure 7:
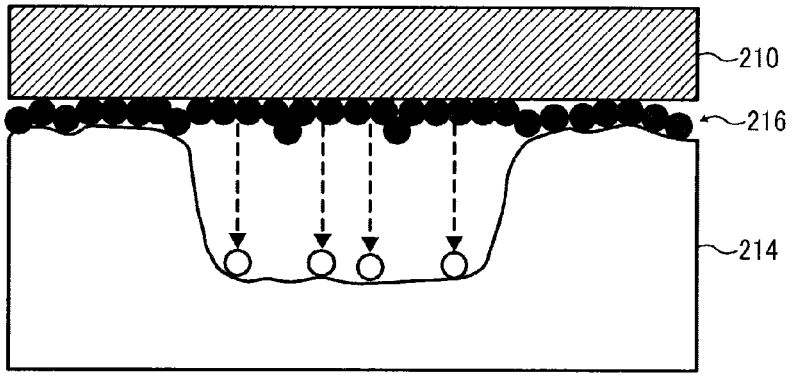
FIG. 7 is an enlarged schematic diagram illustrating behavior of toner at the beginning of transfer.
Figure 8:
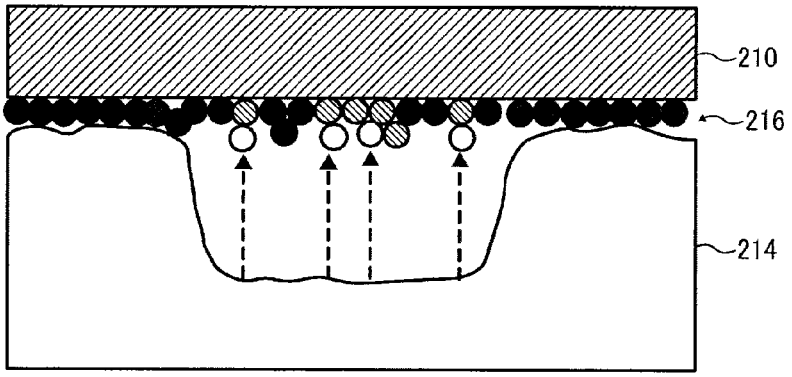
FIG. 8 is an enlarged schematic diagram illustrating behavior of toner in the middle period of transfer.

More specifically, in the transfer nip, there was one back-and-forth movement of toner particles in every cycle 1/f of the AC component of the transfer bias due to a single action of the alternating electric field. In the first cycle, only toner particles present on a surface of the toner layer 216 separated from the toner layer 216, as illustrated in FIG. 7. The toner particles then entered the recessed portions of the recording sheet 214, and thereafter returned to the toner layer 216, as illustrated in FIG. 8. In this process, the returning toner particles collided with other toner particles remaining in the toner layer 216, thereby reducing the adhesion of the other toner particles to the toner layer 216 or to the transparent substrate 210.

In the next cycle, therefore, a larger amount of toner particles than in the last cycle separated from the toner layer 216, as illustrated in FIG. 8. The toner particles then entered the recessed portions of the recording sheet 214, and thereafter returned to the toner layer 216, as illustrated in FIG. 8. In this process, the returning toner particles collided with other toner particles remaining in the toner layer 216, thereby reducing the adhesion of the other toner particles to the toner layer 216 or to the transparent substrate 210.

Figure 9:
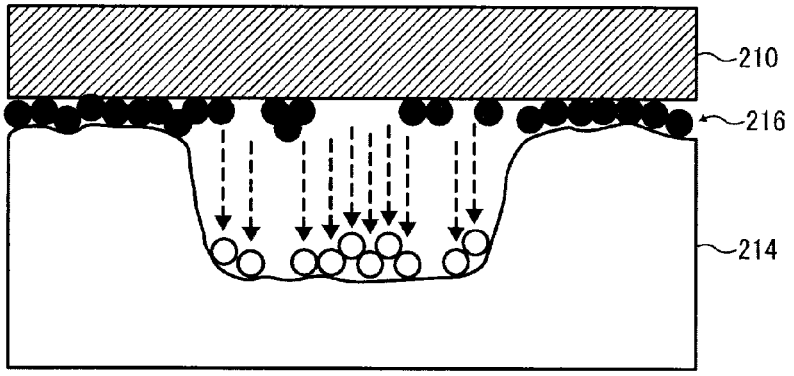
FIG. 9 is an enlarged schematic diagram illustrating behavior of toner at the end of transfer.

In the next cycle, therefore, a larger amount of toner particles than in the last cycle separated from the toner layer 216, as illustrated in FIG. 9. As described above, the number of toner particles moving back and forth was gradually increased in every back-and-forth movement. After the lapse of a nip passage time, for example, a time corresponding to the actual nip passage time in the observation experiment equipment 200, a sufficient amount of toner had been transferred to the recessed portions of the recording sheet 214.

Further, the behavior of the toner was photographed under conditions with a DC voltage of approximately 200 V and the peak-to-peak voltage Vpp of approximately 800 V, and the following phenomenon was observed. That is, some of the toner particles in the toner layer 216 present on the surface thereof separated from the toner layer 216 in the first cycle, and entered the recessed portions of the recording sheet 214. Subsequently, however, the toner particles in the recessed portions remained therein, without returning to the toner layer 216.

In the next cycle, a very small number of toner particles newly separated from the toner layer 216 and entered the recessed portions of the recording sheet 214. After the lapse of the nip passage time, therefore, only a relatively small amount of toner particles had been transferred to the recessed portions of the recording sheet 214.

The present inventors conducted further experiments, and found the following. That is, a returning peak value Vr capable of causing the toner particles having separated from the toner layer 216 and entered the recessed portions of the recording sheet 214 to return to the toner layer 216 in the first cycle depends on the toner adhesion amount per unit area on the transparent substrate 210. More specifically, the larger the toner adhesion amount on the transparent substrate 210, the larger the returning peak value Vr capable of causing the toner particles in the recessed portions in the recording sheet 214 to return to the toner layer 216.

Figure 10:
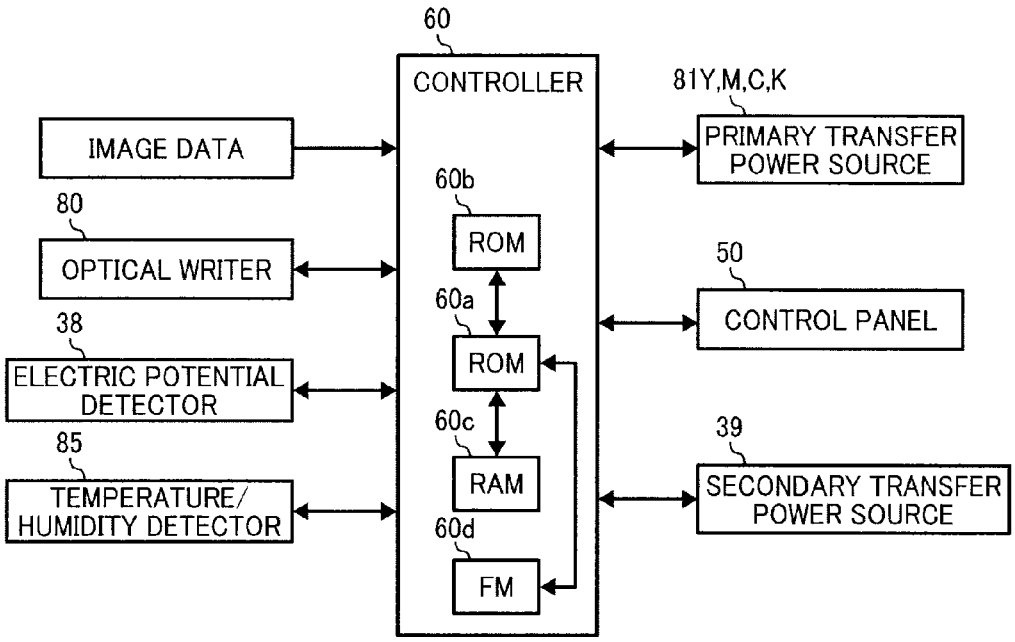
FIG. 10 is a block diagram illustrating a portion of an electrical circuit of the image forming apparatus of FIG. 4.

With reference to FIG. 10, a description is provided of characteristic configurations of the image forming apparatus according to an illustrative embodiment. FIG. 10 is a block diagram illustrating a part of an electrical circuit of the image forming apparatus shown in FIG. 4.

As illustrated in FIG. 10, a controller 60 constituting a part of the transfer bias generator includes a Central Processing Unit (CPU) 60*a* serving as an operation device, a Random Access Memory (RAM) 60*c* serving as a nonvolatile memory, a Read-Only Memory (ROM) 60*b* serving as a temporary storage device, and a flash memory (FM) 60*d*. The controller 60 controlling the entire image forming apparatus is connected to a variety of devices and sensors. FIG. 10, however, illustrates only devices and sensors related to the characteristic configurations of the image forming apparatus.

Primary transfer bias power sources 81Y, 81M, 81C, and 81K supply a primary transfer bias to the primary transfer rollers 35Y, 35M, 35C, and 35K. The secondary transfer bias power source 39 outputs the secondary transfer bias to be applied to the secondary transfer back surface roller 33, and constitutes a transfer bias output mechanism together with the controller 60.

The control panel 50 includes a touch panel and a plurality of key buttons. The control panel 50 displays an image on a screen of the touch panel, and receives an instruction input by the user on the touch panel or the key buttons. The control panel 50 is capable of showing an image on the touch panel on the basis of a control signal transmitted from the controller 60.

As described above, according to the first illustrative embodiment, the time T1 is longer than the time T2, where T1 is a transition time from a time at which the current for forming the transfer-direction electric field reaches its maximum (It) to a time at which the current for forming the return-direction electric field reaches its maximum (Ir), and T2 is a transition time from Ir to It.

The back-and-forth movement of toner enhances transferability of toner to a coarse surface of the recording medium. In order to move toner back and forth, after the transfer-direction electric field is formed, the return-direction electric field is formed. Ultimately, the toner needs to be transferred onto the recording medium. Thus, the time-averaged electric current Iave needs to be sufficiently large at the transfer-direction side.

In view of the above, the time T1 is longer than the time T2 so that the level of time-averaged electric current Iave can be relatively high. Furthermore, the transition from Ir to It is made relatively fast, thereby forming a minimum required return-direction electric field.

According to the first illustrative embodiment, the ratio of transitional time from Ir to It to the entire transfer bias is referred to as a return ratio [%].

According to the second illustrative embodiment, the time T3 during which the transfer-direction current is applied is longer than the time T4 during which the return-direction current is applied.

The back-and-forth movement of toner enhances transferability of toner to a coarse surface of the recording medium. In order to move toner back and forth, after the transfer-direction electric field is formed, the return-direction electric field needs to be formed. Ultimately, the toner needs to be transferred onto the recording medium. Thus, the time-averaged electric current Iave needs to be sufficiently large at the transfer-direction side.

In view of the above, the time T3 during which the transfer-direction current is applied is longer than the time T4 during which the return-direction current is applied. With this configuration, the level of time-averaged electric current Iave can be relatively high. Furthermore, the transition from Ir to It is made relatively fast, thereby forming the minimum required return-direction electric field.

According to the second illustrative embodiment, the ratio of time during which the current having a polarity opposite that of the transfer-direction current is applied to the entire transfer bias is referred to as the return ratio [%].

Next, a description is provided of printing experiments and characteristic configurations of the image forming apparatus according to the illustrative embodiments of the present invention. As can be understood from FIGS. 3A and 3B, the waveforms of the transfer bias of the first illustrative embodiment and the transfer bias of the second illustrative embodiment can be the same. That is, the conditions of the first and the second illustrative embodiments can be satisfied using a transfer bias having the same waveform. Therefore, the following experiments are applicable to the first and the second illustrative embodiments.

First Experiment

A test machine having the same configurations as the image forming apparatus shown in FIG. 4 was used for the following experiments. Various printing tests were performed using the test machine. The process linear velocity for the photosensitive drums 2 and the intermediate transfer belt was 173 mm/s. The frequency f of the AC component of the secondary transfer bias was 500 Hz. The transferability was evaluated using a textured paper called "LEATHAC 66" (a trade name, manufactured by TOKUSHU PAPER MFG CO., LTD.) having a ream weight of 175 Kg (788×1091 mm).

LEATHAC 66 was used as a recording medium P. The degree of roughness of the surface of "LEATHAC 66" is greater than that of "SAZANAMI". The maximum depth of the recessed portions of the surface of LEATHAC 66 was approximately 100 μm. A solid blue image was formed by superimposing a solid magenta image and a solid cyan image one atop the other, and then the solid blue image was output onto a sheet of LEATHAC 66 under different secondary bias conditions. The solid blue image on both the recessed portions and the projecting portions was evaluated with different levels of peak-to-peak voltage Vpp and offset voltage Vave (comparative examples and the illustrative embodiments) and graded as GOOD, FAIR, and POOR. The results are shown in FIGS. 11A through 21B. Here, "GOOD" means that the result of an integrated evaluation in a fifth experiment (described later) was either A or B. "FAIR" means that the result of the integrated evaluation was either C or D. "POOR" means that the result of the integrated evaluation was E.

The experiments were performed at a temperature of 10° C. and humidity of 15%.

A function generator FG300 manufactured by Yokogawa Meters & Instruments Corporation was used to generate waveforms which was then amplified by 1000 times by TREK Model 10/40 High-Voltage Power Amplifier manufactured by TREK, INC. The bias was then applied to the secondary transfer back surface roller 533.

The voltages and currents shown in the following examples were read through the outputs from the amplifier. Alternatively, the voltages and currents applied to the transfer device may be monitored directly. In such a case, as long as the conditions specified in an illustrative embodiment are met, an absolute value of the voltages and the currents may change.

Figures 11A, 11B:
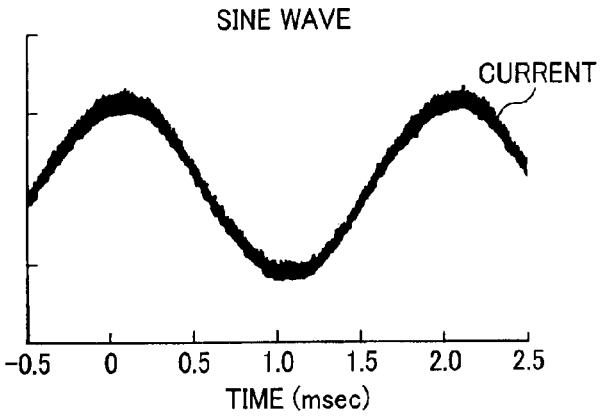
FIG. 11A is a graph showing a waveform of a bias of a first comparative example in experiments performed by the present inventors.
FIG. 11B shows results of the experiments.

In a first comparative example, a bias having a conventional sinusoidal wave was applied. The waveform is shown in FIG. 11A. The return ratio was 50%. The results of the evaluation are shown in FIG. 11B. In FIG. 11B, "R" refers to insufficient transfer of toner relative to the recessed portions of the surface of the sheet. "P" refers to insufficient transfer of toner relative to the projecting portions or flat portions of the surface of the sheet. White spots refer to dropouts or white spots generated on the surface. To understand the results at a glance, in the following drawings, a range in which the results were evaluated as "FAIR" or above is surrounded by broken lines.

Figures 12A, 12B:
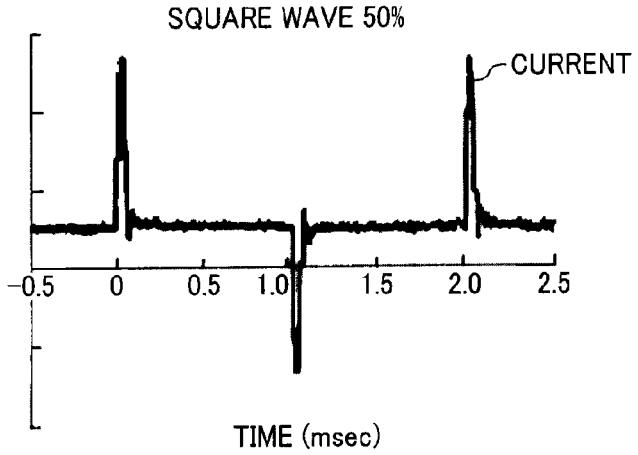
FIG. 12A is a graph showing a waveform of a bias of a second comparative example in the experiments.
FIG. 12B shows results of the experiments.

In a second comparative example, a bias having a square wave was applied. The waveform is shown in FIG. 12A, and the results of the evaluation are shown in FIG. 12B. The return ratio was 50%.

Figures 13A, 13B:
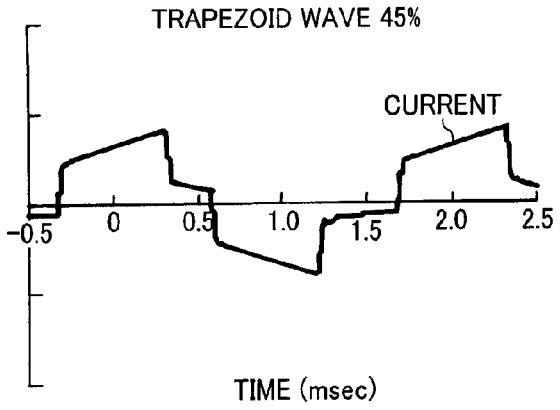
FIG. 13A is a graph showing a waveform of a bias of the first illustrative embodiment in the experiments.
FIG. 13B shows results of the experiments.

In the first embodiment, a bias was applied such that the time T1 (from It to Ir) was longer than the time T2 (from Ir to It). The waveform is shown in FIG. 13A, and the results are shown in FIG. 13B. The return ratio was 45%.

Figures 14A, 14B:
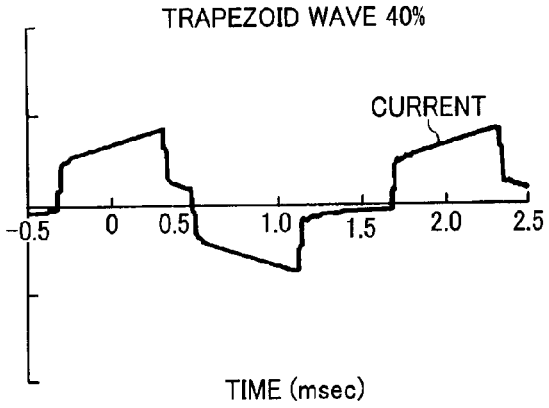
FIG. 14A is a graph showing a waveform of a bias of the second illustrative embodiment in the experiments.
FIG. 14B shows results of the experiments.

In a second embodiment, a bias was applied such that the time T1 (from It to Ir) was longer than the time T2 (from Ir to It). The waveform is shown in FIG. 14A, and the results are shown in FIG. 14B. The return ratio was 40%.

Figures 15A, 15B:
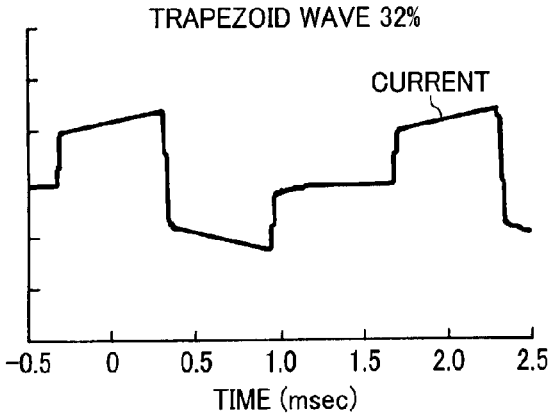
FIG. 15A is a graph showing a waveform of a bias of a third illustrative embodiment in the experiments.
FIG. 15B shows results of the experiments.

In a third embodiment, a bias was applied such that the time T1 (from It to Ir) was longer than the time T2 (from Ir to It). The waveform is shown in FIG. 15A, and the results are shown in FIG. 15B. The return ratio was 32%.

Figures 16A, 16B:
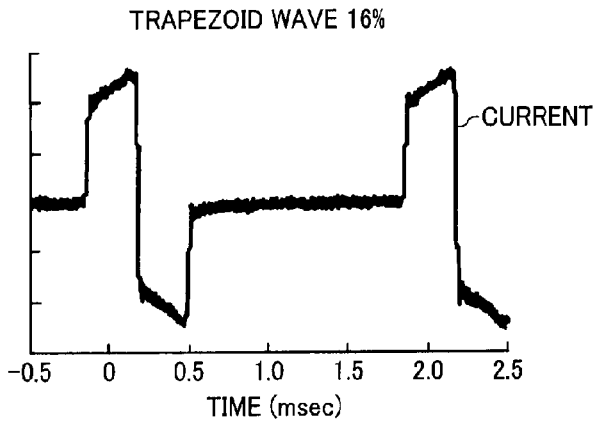
FIG. 16A is a graph showing a waveform of a bias of a fourth illustrative embodiment in the experiments.
FIG. 16B shows results of the experiments.

In a fourth embodiment, a bias was applied such that the time T1 (from It to Ir) was longer than the time T2 (from Ir to It). The waveform is shown in FIG. 16A, and the results are shown in FIG. 16B. The return ratio was 16%.

Figures 17A, 17B:
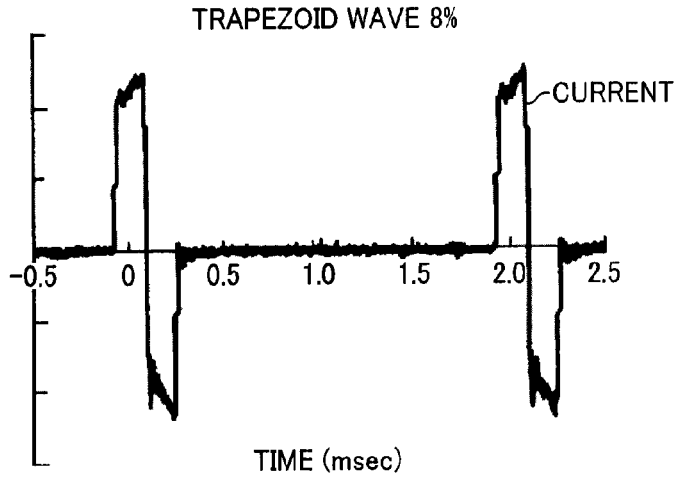
FIG. 17A is a graph showing a waveform of a bias of a fifth illustrative embodiment in the experiments.
FIG. 17B shows results of the experiments.

In a fifth embodiment, a bias was applied such that the time T1 (from It to Ir) was longer than the time T2 (from Ir to It). The waveform is shown in FIG. 17A, and the results are shown in FIG. 17B. The return ratio was 8%.

Figures 18A, 18B:
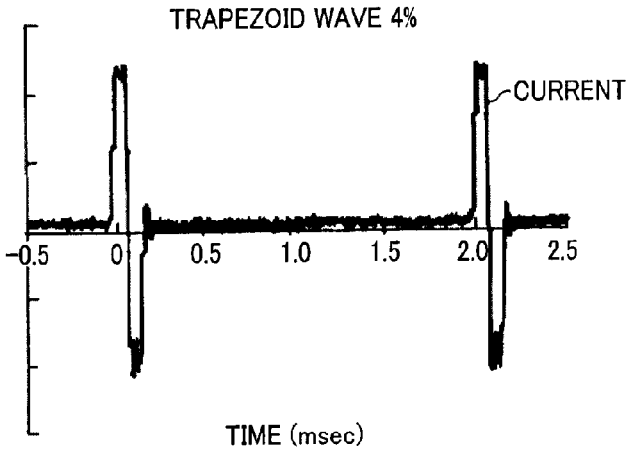
FIG. 18A is a graph showing a waveform of a bias of a sixth illustrative embodiment in the experiments.
FIG. 18B shows results of the experiments.

In a sixth embodiment, a bias was applied such that the time T1 (from It to Ir) was longer than the time T2 (from Ir to It). The waveform is shown in FIG. 18A, and the results are shown in FIG. 18B. The return ratio was 4%.

Figures 19A, 19B:
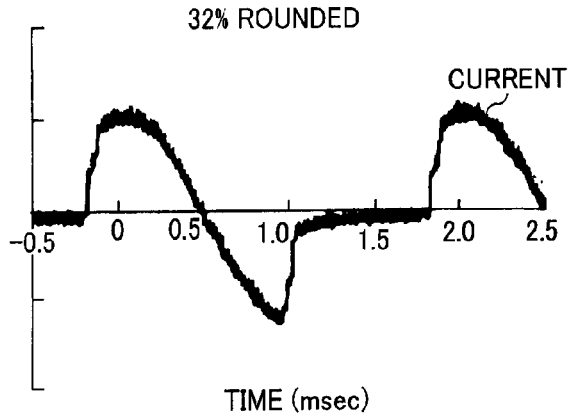
FIG. 19A is a graph showing a waveform of a bias of a seventh illustrative embodiment in the experiments.
FIG. 19B shows results of the experiments.

In a seventh embodiment, a bias was applied such that the time T1 (from It to Ir) was longer than the time T2 (from Ir to It), but the waveform was rounded. The waveform is shown in FIG. 19A, and the results are shown in FIG. 19B. The return ratio was 32%.

Figures 20A, 20B:
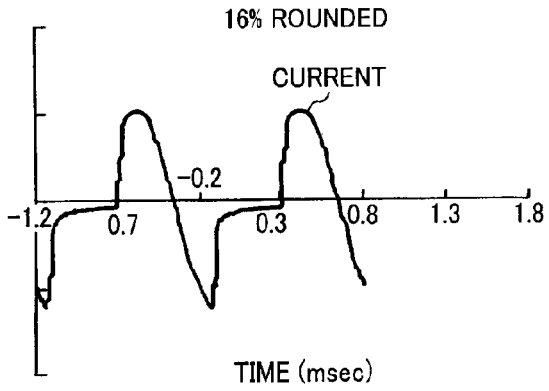
FIG. 20A is a graph showing a waveform of a bias of a eighth illustrative embodiment in the experiments.
FIG. 20B shows results of the experiments.

In an eighth embodiment, a bias was applied such that the time T1 (from It to Ir) was longer than the time T2 (from Ir to It), but the waveform was rounded. The waveform is shown in FIG. 20A, and the results are shown in FIG. 20B. The return ratio was 16%.

In a ninth embodiment, a bias was applied such that the time T1 (from It to Ir) was longer than the time T2 (from Ir to It). The results are shown in FIG. 21. The return ratio was 20%.

Second Experiment

Figure 22:
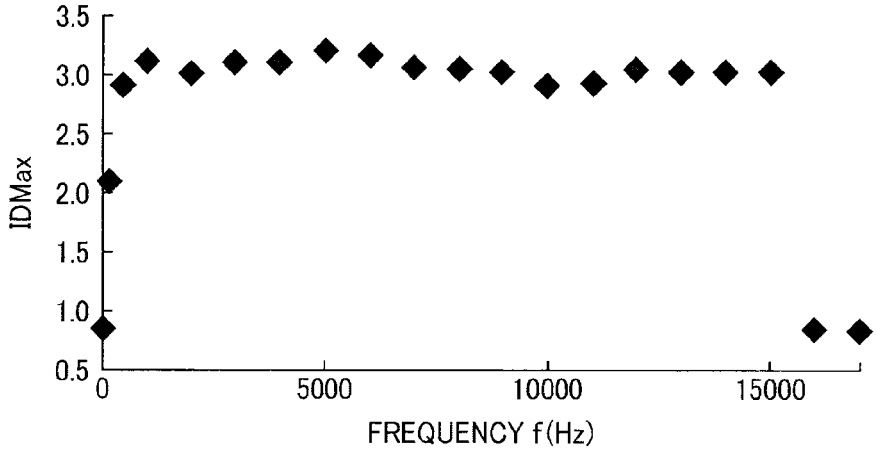
FIG. 22 is a graph showing results of a second experiment.

In a second experiment, the present inventors studied a minimum threshold time "t1" at which toner having entered the recessed portions of the sheet surface was effectively returned to the secondary transfer nip. More specifically, under the return ratio of 50%, a frequency "f" of the AC component of the secondary transfer bias was changed, and the image density of the solid blue image on the recessed portions was measured. FIG. 22 shows a relation between an IDmax (maximum image density) of the recessed portions and the frequency f of the AC component obtained in the second experiment.

As understood in FIG. 22, when the frequency f exceeds 15000 Hz, the image density ID of the recessed portions drops sharply. This may be because the returning time during which an electric current forms the return-direction electric field was too short to move the toner back and forth. The returning time at the frequency f 15000 Hz was 0.033 msec. Hence, the minimum returning time is preferably set as approximately 0.03 msec.

In view of the above, according to the first illustrative embodiment, the bias current is output such that the time T2 during which the maximum current (Ir) that forms the return-direction electric field to become the maximum current (It) that forms the transfer-direction electric field is equal to or greater than 0.03 msec. Further, according to the second illustrative embodiment, the bias current is output such that the time T4 during which the return-direction current is applied is equal to or greater than 0.03 msec.

Third Experiment

In the third experiment, the solid blue image was output with a peak-to-peak voltage Vpp of AC component of 2500 V, an offset voltage Vave of −800 V, and a returning time ratio of 20%. The frequency "f" of the AC component of the secondary transfer bias and the process linear velocity v were changed. The resulting output image was visually inspected. Unevenness of image density (pitch unevenness) caused possibly by an alternating electric field in the secondary transfer nip was evaluated.

Under the same frequency f, the faster the process linear velocity V, the more easily unevenness of image density occurred. Under the same process linear velocity v, the lower the frequency f, the more easily unevenness of image density occurred. These results indicate that unevenness of image density occurs unless the toner moves back and forth between the transfer belt and the recessed portions of the surface of the sheet for a number of times in the secondary transfer nip.

When the process linear velocity v was 282 mm/s and the frequency f was 400 Hz, no unevenness of image density was observed. However, when the process linear velocity v was 282 mm/s and the frequency f was 300 Hz, unevenness of image density was observed. The width d of the secondary transfer nip in the direction of movement of the belt was approximately 3 mm. The number N of back-and-forth movement of toner in the secondary transfer nip in the above-described condition is calculated as approximately 4 times (3×400/282), which is the minimum number of back-and-forth movement of toner that does not cause unevenness of image density.

When the process linear velocity v was 141 mm/s and the frequency f was 200 Hz, no unevenness of image density was observed. However, when the process linear velocity v was 141 mm/s and the frequency f was 100 Hz, unevenness of image density was observed. Similar to the condition with the process linear velocity v of 282 mm/s and the frequency f of 400 Hz, the number N of back-and-forth movement of toner under the condition with the process linear velocity v of 141 mm/s and the frequency f of 200 Hz is calculated as approximately 4 times (3×200/141). Therefore, by satisfying the following relation "frequency f>(4/d)×v" is satisfied, an image without unevenness of image density can be obtained.

In view of the above, according to the illustrative embodiments of the present invention, the secondary transfer power source 39 of the image forming apparatus can output the AC component that satisfies "frequency f>(4/d)×v".

It is to be noted that in order to satisfy such a condition, the image forming apparatus includes a communication device that obtains printer driver setting information transmitted from the control panel 50 serving as an information retrieval mechanism and external devices such as a personal computer (PC). Based on the obtained information, the print mode is selected from the high-speed mode, the normal mode, and the slow-speed mode. Accordingly, the process linear velocity v is determined.

In the secondary transfer nip, toner is not transferred well onto the recording medium P unless a certain amount of transfer current flows through the recording medium P. As is obvious, the transfer current does not flow well through a relatively thick recording medium as compared with a recording medium having a normal thickness. Of course, it is desirable to transfer toner properly to embossed recording media sheets having a coarse surface such as Japanese paper known as "Washi", regardless of the thickness thereof. In view of this, in a fourth experiment, how to control the secondary transfer bias was studied.

Fourth Experiment

In the fourth experiment, as the secondary transfer power source 39, a power source that outputs a peak-to-peak voltage Vpp having AC component and an offset voltage Vave, both of which were subjected to constant voltage control, was employed. The process linear velocity v was 282 mm/s. As a recording medium P, LEATHAC 66 (a trade name) having a ream weight of 175 kg was used, and an A4-size solid black test image was formed thereon. The returning time ratio was 40%. The offset voltage Vave was in a range of from approximately 800 V to approximately 1800 V. The peak-to-peak voltage Vpp was in a range of from approximately 3 kV to 8 kV. The frequency f was 500 Hz.

The image density of the solid black image on the recessed portions of the sheet surface was graded on a five point scale of 1 to 5, where 5 is the highest grade.

Grade 5: The recessed portions were filled with toner completely.

Grade 4: The recessed portions were filled with toner mostly, but a sheet portion was slightly seen in the recessed portions having a relatively large depth.

Grade 3: A sheet portion was clearly seen in the recessed portions having a relatively large depth.

Grade 2: An amount of the sheet portion seen in the recessed portions was more than that in Grade 3, but better than that in Grade 1.

Grade 1: Toner was not adhered to the recessed portions at all.

The image density of the solid black image on the projecting portions of the sheet surface was graded on a five point scale of 1 to 5, where 5 is the highest grade.

Grade 5: There was no unevenness of image density, that is, good image density was obtained throughout the image.

Grade 4: There was slight unevenness of image density, but satisfying image density was obtained at the place at which the image density was relatively low.

Grade 3: There was unevenness of image density, and the place at which the image density was low was below an acceptable level.

Grade 2: Worse than Grade 3, but better than Grade 1.

Grade 1: The image density was insufficient throughout the image.

Subsequently, the evaluation of the image density of the recessed portions and the evaluation of the image density of the projecting portions are integrated as follows.

Grade A: The grades of image density of both recessed portions and projecting portions are Grade 5 or above.

Grade B: The grades of image density of both recessed portions and projecting portions are Grade 4 or above.

Grade C: The grade of image density of only recessed portions is Grade 3 or below.

Grade D: The grade of image density of only projecting portions is Grade 3 or below.

Grade E: The grades of image density of both recessed portions and projecting portions are Grade 3 or below.

Next, the same experiment was performed except that LEATHAC 66 having a ream weight of 215 kg which is thicker than LEATHAC 66 having a ream weight of 175 kg was used. Combinations of the offset voltage Vave and the peak-to-peak voltage Vpp that achieved the integrated evaluations Grade A or Grade B on both LEATHAC 66 having a ream weight of 175 kg and LEATHAC 66 having a ream weight of 215 kg were extracted from the above-described combinations of the offset voltage Vave and the peak-to-peak voltage Vpp.

As a result, no combination obtained Grade A on both types of sheets. The combination that obtained Grade B on both types of sheets was a combination of the peak-to-peak voltage Vpp of 6 kV and the offset voltage Vave of −1100±100 V (median=±9%).

Fifth Experiment

In a fifth experiment, as the secondary transfer power source 39, a power source that outputs a peak-to-peak voltage Vpp having an AC component and an offset voltage Vave, both of which were subjected to constant current control, was employed. The target value of the output (offset current Iave) was set in a range of from −30 μA to −60 μA. Except for the conditions described above, the same conditions employed in the fourth experiment were employed in the fifth experiment.

As a result, the combination of the peak-to-peak voltage Vpp and the offset current Iave that achieved Grade A or above on both LEATHAC 66 having a ream weight of 175 kg and LEATHAC 66 having a ream weight of 215 kg was a combination of the peak-to-peak voltage Vpp of 7 kV and the offset current Iave of −42.5±7.5 μA (median±18%). The combination that achieved Grade B on both types of sheets was a combination of the peak-to-peak voltage Vpp of 7 kV and the offset current Iave of −47.5±12.5 μA (median=±26%).

As described above, in the fourth experiment, no combination achieved Grade A on both types of sheets. By contrast, in the fifth experiment, there was a combination that can achieve Grade A on both types of sheets. Furthermore, for the combination that achieved Grade B, the offset voltage Vave was −1100±100 V (median±9%) in the fourth experiment; by contrast, in the fifth experiment, the peak-to-peak voltage Vpp was 7 kV and the offset current Iave was −47.5 μA±12.5 μA (median±26%). It is obvious that the latter has a wider range from the median value. These results of the experiments indicate that, as compared with controlling the DC component under constant voltage control, controlling the DC component under constant current control can provide a wider range of control target value that can accommodate different thicknesses of recording media sheets.

In view of the above, according to the illustrative embodiments of the present invention, the secondary transfer power source 39 is configured to output a DC component under constant current control. Furthermore, as for the AC component, the secondary transfer power source 39 outputs a constant-current controlled peak-to-peak current. With this configuration, the peak-to-peak current is constant regardless of environmental changes. Therefore, an effective returning peak current and transfer peak current can be generated reliably.

According to the results of the experiments as described above, as compared with the first and the second comparative examples, a range of successful transfer of toner onto the recording medium having a coarse surface increases significantly in the first embodiment. With the increased range of successful transfer of toner, sufficient image density can be achieved in both recessed and projecting portions of the surface of a recording medium even when parameters of sheet types, image patterns, environmental conditions, and so forth change while preventing image defects such as dropouts and white spots. Accordingly, a good output image can be obtained.

Furthermore, according to the illustrative embodiments, it is not necessary to always monitor the voltage because the level of the transfer peak value Vt does not become too high, hence allowing simplification of the configurations and control.

By outputting the bias current such that the ratio of the time T2 or the time T4 to the entire transfer bias is equal to or greater than 4% and equal to or less than 45%, the return ratio is prevented from getting too small, thereby maintaining reliably a certain range of successful transfer of toner.

Furthermore, with the ratio of the time T2 or the time T4 to the entire transfer bias being equal to or greater than 8% and equal to or less than 40%, even wider range of successful transfer of toner can be attained.

Still further, with the ratio of the time T2 or the time T4 to the entire transfer bias being equal to or greater than 8% and equal to or less than 20%, the range of successful transfer of toner can be attained more reliably.

By outputting the bias current such that the time T2 or the time T4 is 0.03 msec or more, a sufficient amount of returning time during which an electric current forms the return-direction electric field is secured, thereby preventing degradation of transferability in the recessed portions of the recording medium.

Referring now to FIG. 5, there is provided a schematic diagram illustrating the developing device 8 employed in the image forming apparatus shown in FIG. 4. The developing devices 8K, 8C, 8M, and 8Y all have the same configuration, differing only in the color of toner employed. Thus, a description is provided of the developing device 8K as a representative example of the developing devices.

As illustrated in FIG. 5, the developing device 8K includes a developing section including a developing roller 9K and a developer conveyer 13K. The developer conveyer 13K mixes a black color developing agent and feeds the developing agent to the developing roller 9K. The developer conveyer 13K includes a first chamber equipped with a first screw 10K and a second chamber equipped with a second screw 11K. The first screw 10K and the second screw 11K are each constituted of a rotatable shaft and helical flighting wrapped around the circumferential surface of the shaft. Each end of the shaft of the first screw 10K and the second screw 11K in the axial direction is rotatably held by shaft bearings.

The first chamber with the first screw 10K and the second chamber with the second screw 11K are separated by a wall, but each end of the wall in the direction of the screw shaft has a connecting hole through which the first chamber and the second chamber are connected. The first screw 10K mixes the developing agent by rotating the helical flighting and carries the developing agent from the distal end to the proximal end of the screw in the direction perpendicular to the surface of the recording medium while rotating. The first screw 10K is disposed parallel to and facing the developing roller 9K. Hence, the developing agent is delivered along the axial (shaft) direction of the developing roller 9K. The first screw 10K supplies the developing agent to the surface of the developing roller 9K along the direction of the shaft line of the developing roller 9K.

The developing agent transported near the proximal end of the first screw 10*k* passes through the connecting hole in the wall near the proximal side and enters the second chamber. Subsequently, the developing agent is carried by the helical flighting of the second screw 11K. As the second screw 11K rotates, the developing agent is delivered from the proximal end to the distal end in the drawing while being mixed in the direction of rotation.

In the second chamber, a toner density detector for detecting the density of toner in the developing agent is disposed at the bottom of a casing of the chamber. As the toner density detector, a magnetic permeability detector is employed. There is a correlation between the toner density and the magnetic permeability of the developing agent consisting of toner and a magnetic carrier. Therefore, the magnetic permeability detector can detect the density of the toner.

Although not illustrated, the image forming apparatus includes toner supply devices to supply independently toner of yellow, magenta, cyan, and black to the second chamber of the respective developing device 8. The controller 60 of the image forming apparatus includes the Random Access Memory (RAM) to store a target output voltage Vtref for output voltages provided by the toner density detectors for yellow, magenta, cyan, and black. If the difference between the output voltages provided by the toner detectors for yellow, magenta, cyan, and black, and Vtref for each color exceeds a predetermined value, the toner supply devices are driven for a predetermined time period corresponding to the difference to supply toner. Accordingly, the respective color of toner is supplied to the second chamber of the developing device 8.

The developing roller 9K in the developing section 12K faces the first screw 10K as well as the photosensitive drum 2K through an opening formed in the casing of the developing device 8K. The developing roller 9K comprises a cylindrical developing sleeve made of a non-magnetic pipe which is rotated, and a magnetic roller disposed inside the developing sleeve. The magnetic roller is fixed to prevent the magnetic roller from rotating together with the developing sleeve. The developing agent supplied from the first screw 10K is carried on the surface of the developing sleeve due to the magnetic force of the magnetic roller. As the developing sleeve rotates, the developing agent is transported to a developing area facing the photosensitive drum 2K.

The developing sleeve is supplied with a developing bias having the same polarity as toner. The developing bias is greater than the bias of the electrostatic latent image on the photosensitive drum 2K, but less than the charging potential of the uniformly charged photosensitive drum 2K. With this configuration, a developing potential that causes the toner on the developing sleeve to move electrostatically to the electrostatic latent image on the photosensitive drum 2K acts between the developing sleeve and the electrostatic latent image on the photosensitive drum 2K.

A non-developing potential acts between the developing sleeve and the non-image formation areas of the photosensitive drum 2K, causing the toner on the developing sleeve to move to the sleeve surface. Due to the developing potential and the non-developing potential, the toner on the developing sleeve moves selectively to the electrostatic latent image formed on the photosensitive drum 2K, thereby forming a visible image, known as a toner image.

Similar to the image forming unit 1K, in the image forming units 1Y, 1M, and 1C, toner images of yellow, magenta, and cyan are formed on the photosensitive drums 2Y, 2M, and 2C, respectively.

With reference to FIGS. 23 through 26, a description is now provided of variations of the configuration of the transfer portion. The same effect as that of the foregoing embodiments can be achieved with the following variations.

Figure 23:
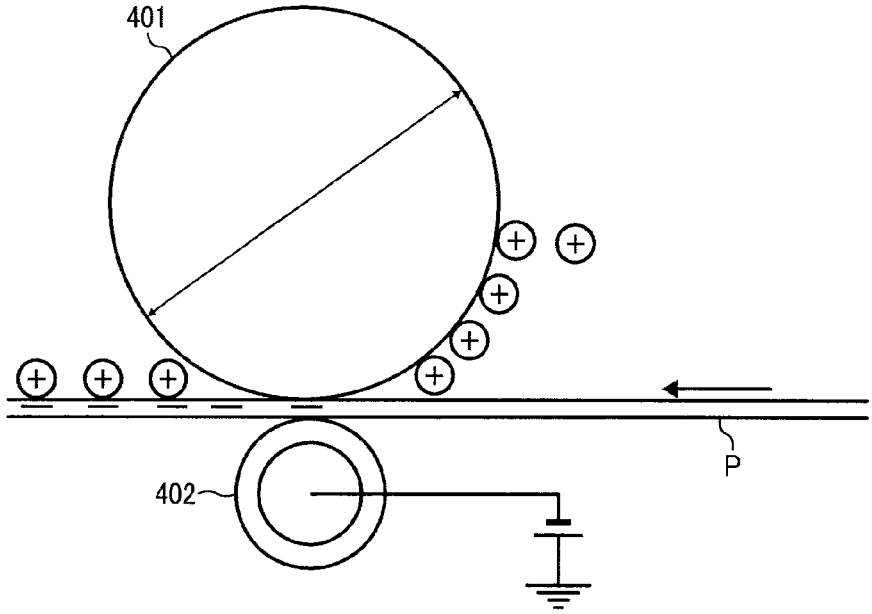
FIG. 23 is a schematic diagram illustrating a first variation of a transfer portion of the image forming apparatus.

FIG. 23 illustrates a first variation of the transfer portion. As illustrated in FIG. 23, a medium-resistant transfer roller 402 contacts a photosensitive drum 401. A bias is applied to the transfer roller 402 to transfer toner from the photosensitive drum 401 to a recording medium (transfer sheet) P while the recording medium P is transported. The photosensitive drum 401 is not limited to a drum. A belt-type photosensitive member may be employed. The transfer roller 402 may include a foam layer (elastic layer) or a surface layer coated with elastic material such as foam.

Figure 24:
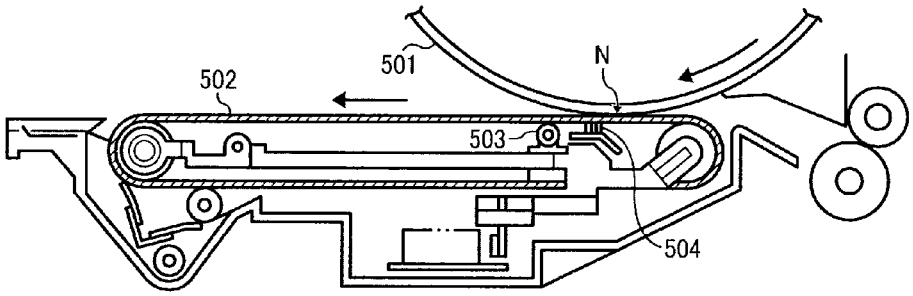
FIG. 24 is a schematic diagram illustrating a second variation of the transfer portion.

FIG. 24 illustrates a second variation of the transfer portion. As illustrated in FIG. 24, a medium-resistant transfer conveyance belt 502 contacts a photosensitive drum 501. A bias is applied to the transfer conveyance belt 502 to transfer toner from the photosensitive drum 501 to the recording medium while the recording medium is transported. The bias is applied to the transfer conveyance belt 502 by a transfer bias roller 503 and a bias application brush 504, each serving as a bias application device. The transfer bias roller 503 and the bias application brush 504 are connected to a high voltage power source.

It is to be noted that the photosensitive drum 501 is not limited to a drum. A belt-type photosensitive member may be employed. The transfer bias roller 503 may include a foam layer (elastic layer) or a surface layer coated with elastic material such as foam.

FIG. 24 shows a roller-type bias application device (transfer bias roller 503) and a brush-type bias application device (bias application brush 504). Alternatively, both of the bias application devices may be rollers or brushes. The bias application devices may be disposed immediately below the transfer nip N or near the transfer nip N. Alternatively, only one bias application device may be employed. In such a case, the bias application device may be either a roller or a brush. The bias application device may be disposed at the place shown in FIG. 24, or below the transfer nip N or near the transfer nip N. Alternatively, as a bias application device, a contact-free bias application device may be employed. In this case, a charger is disposed inside the loop formed by the transfer conveyance belt 502.

Figure 25:
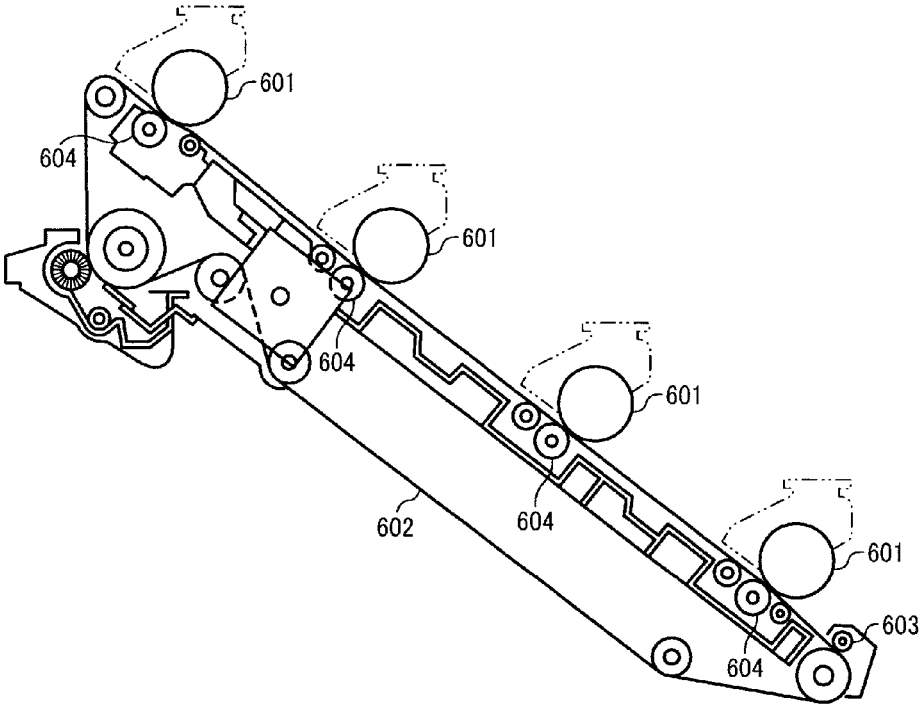
FIG. 25 is a schematic diagram illustrating a third variation of the transfer portion.

FIG. 25 shows a third variation of the transfer portion. In FIG. 25, a transfer conveyance belt 602 contacts a plurality of photosensitive drums 601. Here, four photosensitive drums 601 are disposed. A sheet suction roller 603, to which a predetermined bias voltage (sheet suction bias) is applied, is disposed at the beginning of the transfer conveyance belt 602 (at the bottom right in FIG. 25). The recording medium passing below the sheet suction roller 603 is delivered onto the transfer conveyance belt 602. The recording medium is conveyed while being electrostatically absorbed to the transfer conveyance belt 602. Toner images formed on the photosensitive drums 601 are transferred directly onto the recording medium by transfer devices, that is, transfer rollers 604, each corresponding to the photosensitive drums 601.

In FIG. 25, the transfer bias is applied to the transfer rollers 604 provided to each of the photosensitive drums 601. Each of the transfer rollers 604 is connected to a high voltage power source. Alternatively, all the transfer rollers 604 may be connected to a single high voltage power source. Instead of the transfer roller 604, a brush-type bias application device may be employed. Alternatively, both the transfer roller and a bias application brush may be employed. When employing the bias application brush, the bias application brush may be disposed at the same place as in the second variation shown in FIG. 24. The transfer roller 604 may include a foam layer (elastic layer) or a surface layer coated with elastic material such as foam.

Figure 26:
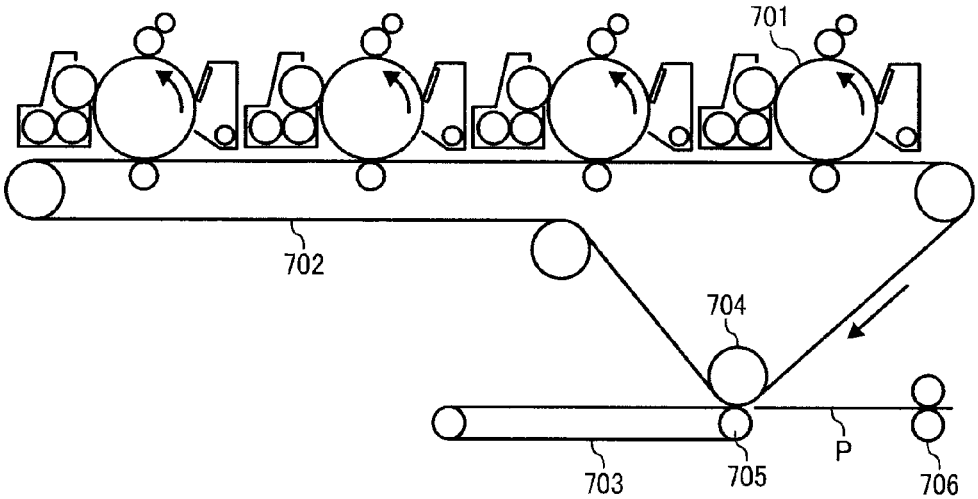
FIG. 26 is a schematic diagram illustrating a fourth variation of the transfer portion.

FIG. 26 shows a fourth variation of the transfer portion. In FIG. 26, a secondary transfer conveyance belt 703 contacts a belt-type intermediate transfer member (hereinafter, intermediate transfer belt) 702, thereby forming a transfer nip. A toner image is transferred onto a recording medium P in the transfer nip, and subsequently, the recording medium is transported to a fixing device by the secondary transfer conveyance belt 703. After the recording medium P is fed by a pair of registration rollers 706, the recording medium P passes through the transfer nip between the intermediate transfer belt 702 and the secondary transfer conveyance belt 703. As the recording medium P passes through the transfer nip, the toner image is transferred onto the recording medium P and then the recording medium P separated from the intermediate transfer belt 702 is delivered to the fixing device (not illustrated) by the secondary transfer conveyance belt 703.

According to the present embodiment, a first roller 704 disposed inside the loop formed by the intermediate transfer belt 702 may serve as a bias application roller to which a bias having a polarity opposite that of the charged toner (normal charging polarity) is applied. This is known as a repulsive force transfer method. Alternatively, a second roller 705 disposed opposite the first roller 704 via the secondary transfer conveyance belt 703 may serve as a bias application roller to which a bias having the same polarity as the toner (normal charging polarity) is applied. This is known as an attraction transfer method.

Furthermore, similar to the second variation shown in FIG. 24, the transfer bias roller and/or the bias application brush may be disposed inside the loop formed by the secondary transfer conveyance belt 703, and the transfer bias is applied to the transfer bias roller and/or the bias application brush. In this case, the transfer bias roller and/or the bias application brush may be disposed at the same place as the second variation shown in FIG. 24. The transfer roller (transfer bias roller) may include a foam layer (elastic layer) or a surface layer coated with elastic material such as foam. Alternatively, a transfer charger may be employed.

Application of the secondary transfer bias is not limited to the configuration illustrated in FIG. 4. With reference to FIGS. 27 through 34, a description is provided of variations of application of the secondary transfer bias.

Figure 27:
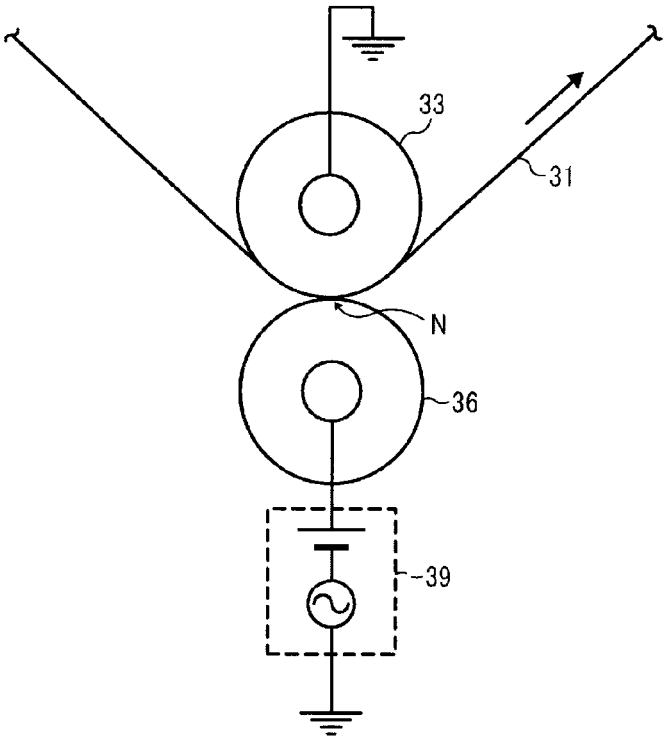
FIG. 27 is a schematic diagram illustrating a first variation of a power source for secondary transfer process.

FIG. 27 shows a case in which the secondary transfer back surface roller 33 is grounded while the superimposed bias output from the power source 39 is applied to the nip forming roller 36. In this case, the polarity of the DC voltage is different from FIG. 4. More specifically, as illustrated in FIG. 27, in a case in which the secondary transfer back surface roller 33 is grounded and the superimposed bias is applied to the nip forming roller 36, the DC voltage having the positive polarity which is opposite that of toner is used so that the time-averaged potential of the superimposed bias has the positive polarity opposite that of the toner.

Figure 28:
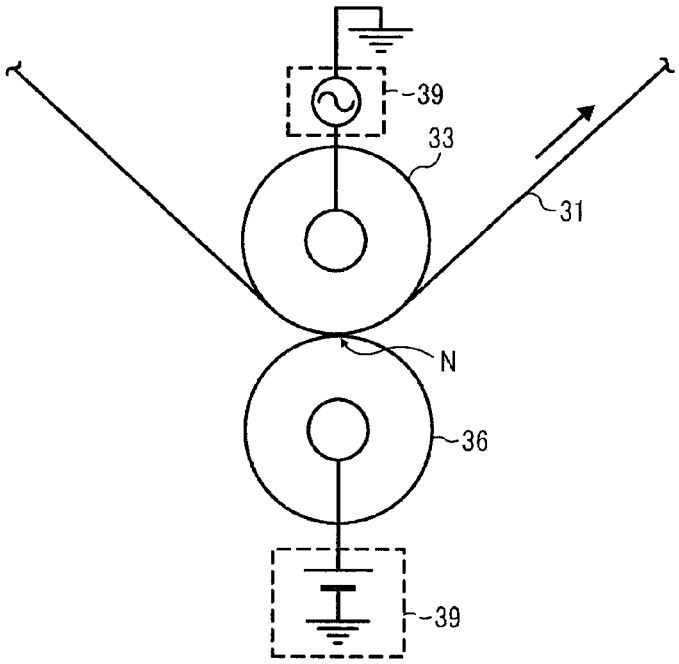
FIG. 28 is a schematic diagram illustrating a second variation of the power source.
Figure 29:
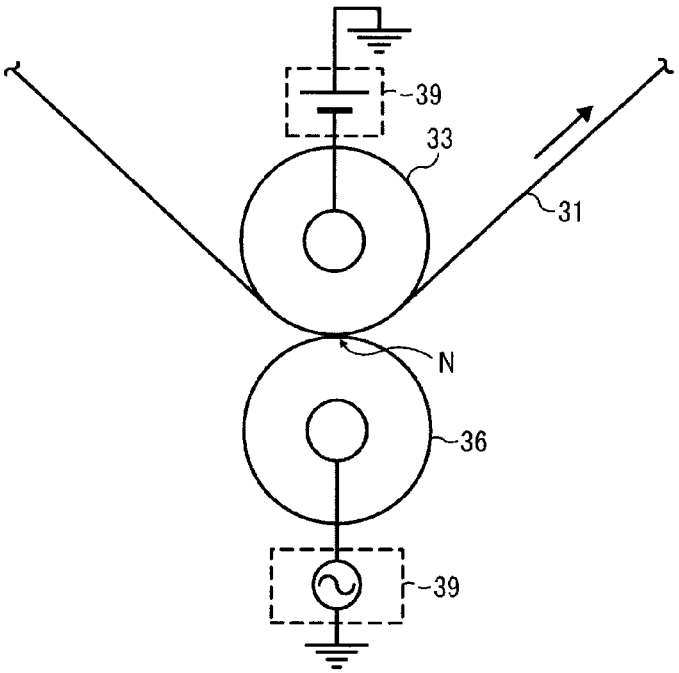
FIG. 29 is a schematic diagram illustrating a third variation of the power source.

FIGS. 28 and 29 show a case in which the DC voltage is supplied from the power source 39 to one of the secondary transfer back surface roller 33 and the nip forming roller 36, and the AC voltage is supplied from the power source 39 to the other roller, instead of supplying the superimposed bias to one of the secondary transfer back surface roller 33 and the nip forming roller 36.

Figure 30:
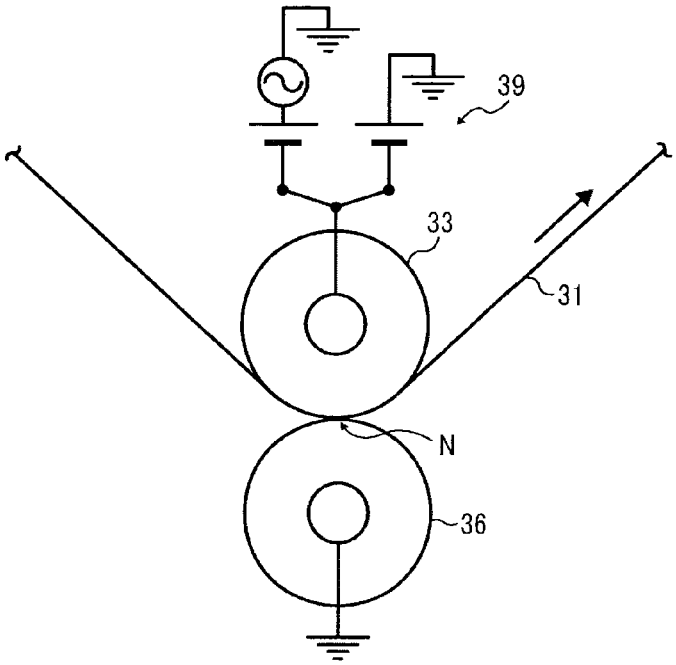
FIG. 30 is a schematic diagram illustrating a fourth variation of the power source.
Figure 31:
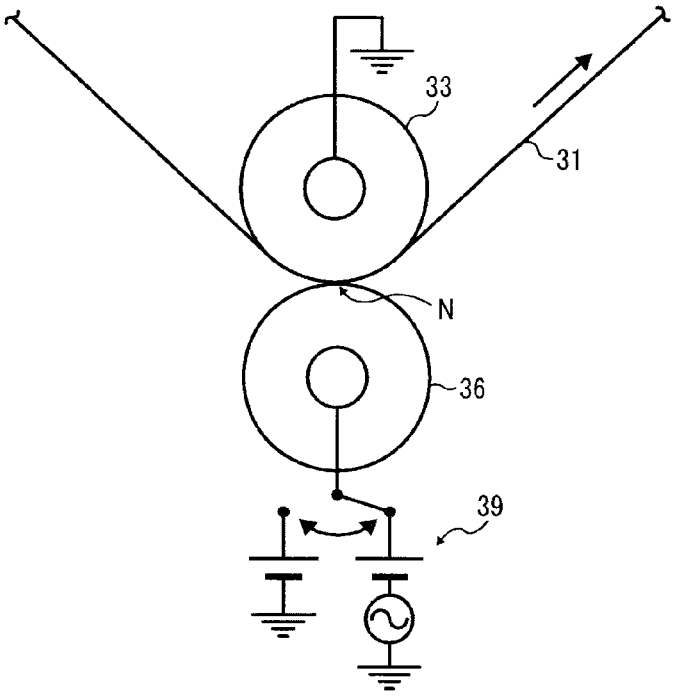
FIG. 31 is a schematic diagram illustrating a fifth variation of the power source.

FIGS. 30 and 31 show a case in which the power source 39 can switch between a combination of the DC voltage and the AC voltage, and the DC voltage, and supply the voltage to one of the secondary transfer back surface roller 33 and the nip forming roller 36. More specifically, FIG. 30 shows a case in which the power source 39 switches the voltage between the combination of the DC voltage and the AC voltage, and the DC voltage, and supplies the voltage to the secondary transfer back surface roller 33. FIG. 31 shows a case in which the power source 39 switches the voltage between the combination of the DC voltage and the AC voltage, and the DC voltage, and supplies the voltage to the nip forming roller 36.

Figure 32:
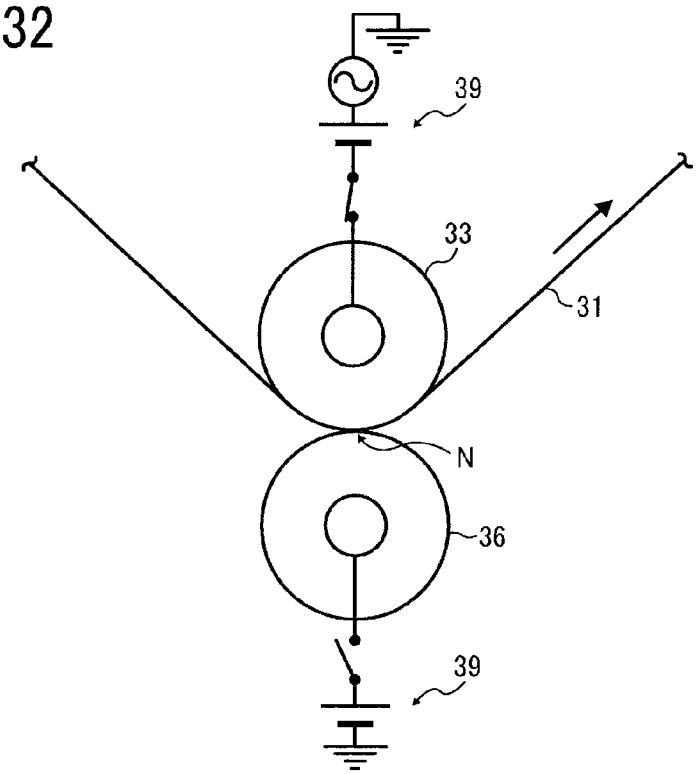
FIG. 32 is a schematic diagram illustrating a sixth variation of the power source.
Figure 33:
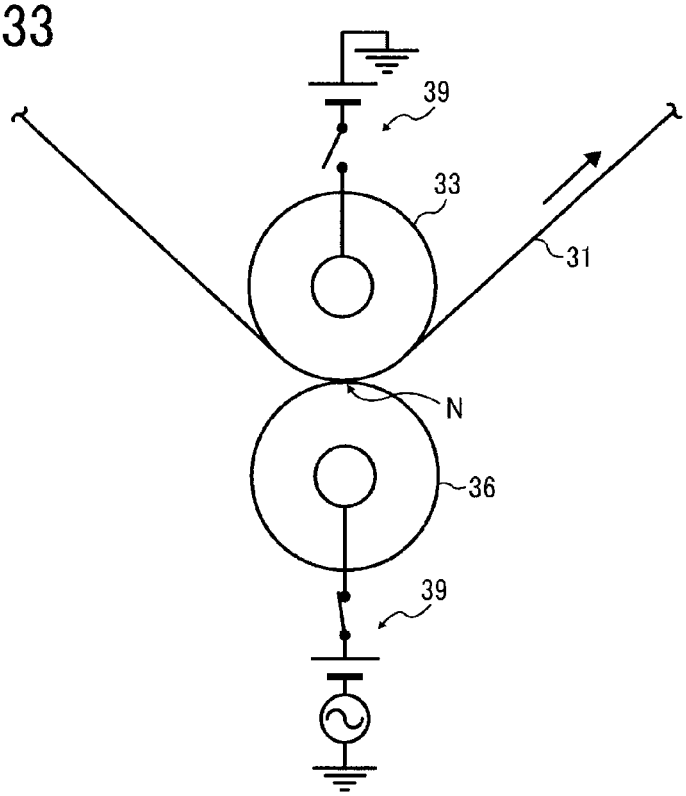
FIG. 33 is a schematic diagram illustrating a seventh variation of the power source.

FIGS. 32 and 33 show a case in which the combination of the DC voltage and the AC voltage can be supplied to one of the secondary transfer back surface roller 33 and the nip forming roller 36, and the DC voltage can be supplied to the other roller. More specifically, FIG. 32 shows a case in which the combination of the DC voltage and the AC voltage can be supplied to the secondary transfer back surface roller 33, and the DC voltage can be supplied to the nip forming roller 36. FIG. 33 shows a case in which the DC voltage can be supplied to the secondary transfer back surface roller 33, and the combination of the DC voltage and the AC voltage can be supplied to the nip forming roller 36.

As described above, there is a variety of ways in which the secondary transfer bias is applied to the secondary transfer nip N. Thus, depending on the secondary transfer bias application, a proper power source may be selected. For example, a power source, such as the power source 39, capable of supplying the combination of the DC voltage and the AC voltage, may be employed. Alternatively, the power source capable of supplying the DC voltage and the AC voltage independently may be employed. Still alternatively, a single power source capable of switching application of the bias between the combination of the DC voltage and the AC voltage, and the DC voltage may be employed.

The power source 39 for the secondary transfer bias includes a first mode in which the power source 39 outputs only the DC voltage and a second mode in which the power source 39 outputs a superimposed voltage including the AC voltage superimposed on the DC voltage. The first mode and the second mode are switchable.

According to the illustrative embodiments shown in FIG. 4 and FIGS. 27 through 29, the first mode and the second mode can be switched by turning on and off the output of the AC voltage.

According to the illustrative embodiments shown in FIGS. 30 through 33, a plurality of power sources (here, two power sources) is employed and switched by a switching device such as a relay. By switching between the two power sources, the first mode and the second mode may be selectively switched.

Figure 34:
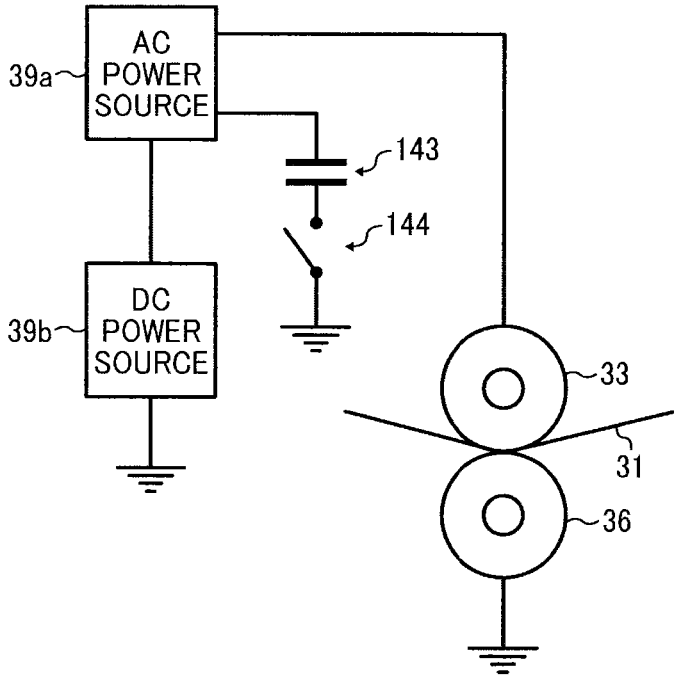
FIG. 34 is a block diagram showing another example of a power source unit.

With reference to FIG. 34, a description is provided of another example of the power source. FIG. 34 is a block diagram illustrating another example of the power source unit. In FIG. 34, the power source unit includes an AC power source 39*a* and a DC power source 39*b*. The AC power source 39*a* includes a bypass capacitor 143. A relay 144 is provided between the bypass capacitor 143 and the ground. This configuration provides the DC component with a fast rise time.

The configuration of the transfer portion is not limited to the configurations described above. The nip forming roller may be substituted by a belt member. The waveform of the transfer bias is not limited to the waveforms described above, and any other waveforms may be employed within the scope of the disclosure.

The configuration of the image forming apparatus is not limited to the configurations described above. The order of image forming units arranged in tandem is not limited to the above described order.

The present invention may be applied to an image forming apparatus using toners in three different colors or less. For example, the present invention may be applied to a multicolor image forming apparatus using two colors of toner and a monochrome image forming apparatus.

According to an aspect of this disclosure, the present invention is employed in the image forming apparatus. The image forming apparatus includes, but is not limited to, a copier, a printer, a facsimile machine, and a multi-functional system.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A transfer device, comprising:

a rotatable image bearing member to bear a toner image on a surface thereof;

a nip forming member to contact the surface of the image bearing member bearing the toner image to form a transfer nip therebetween; and a bias output device to apply a bias to transfer the toner image on the image bearing member onto a recording medium in the transfer nip, the bias output device outputting a bias current to alternately form a transfer-direction electric field to transfer toner charged with a normal polarity in the toner image to move from the image bearing member to the recording medium and a return-direction electric field to return the toner charged with the normal polarity from the recording medium to the image bearing member, wherein a transition time T1 from a first time at which a current for forming the transfer-direction electric field reaches its maximum (It) to a second time at which a current for forming the return-direction electric field reaches its maximum (Ir) is longer than a transition time T2 from the second time to the first time, and wherein the bias output device supplies the bias current having a relation of $f>(4/d)\times v$, where f is a frequency (Hz) of the bias current, d is a width (mm) of the transfer nip in a direction of rotation of the image bearing member, and v is a speed of rotation (mm/s) of the image bearing member.

2. The transfer device according to claim 1, wherein the bias output device supplies the bias current such that a ratio of the transition time T2 to an entire period of bias current is equal to or greater than 4% and equal to or less than 45%.

3. The transfer device according to claim 1, wherein the bias output device supplies the bias current such that a ratio of the transition time T2 to an entire period of bias current is equal to or greater than 8% and equal to or less than 40%.

4. The transfer device according to claim 1, wherein the bias output device supplies the bias current such that a ratio of the transition time T2 to an entire period of bias current is equal to or greater than 8% and equal to or less than 20%.

5. The transfer device, according to claim 1, wherein the bias output device supplies the bias current such that the transition time T2 is equal to or longer than 0.03 msec.

6. The transfer device according to claim 1, wherein the bias output by the bias output device includes a superimposed bias in which a direct current component and an alternating current component are superimposed, and the direct current component is output under constant current control.

7. The transfer device according to claim 6, wherein the bias output device outputs the alternating current component of a peak-to-peak current under constant current control.

8. An image forming apparatus, comprising the transfer device of claim 1.

9. The image forming apparatus according to claim 8, wherein the bias applied by the bias output device includes a superimposed bias in which a direct current component and an alternating current component are superimposed, and the direct current component is output under constant current control, wherein the direct current component of the bias is varied depending on a process linear velocity of the image forming apparatus.

10. A transfer device, comprising:

a rotatable image bearing member to bear a toner image on a surface thereof;

a nip forming member to contact the surface of the image bearing member bearing the toner image to form a transfer nip therebetween; and a bias output device to apply a bias to transfer the toner image on the image bearing member onto a recording medium in the transfer nip;

the bias output device outputting a bias current to alternately form a transfer-direction electric field to transfer toner charged with a normal polarity in the toner image to move from the image bearing member to the recording medium and a return-direction electric field to return the toner charged with the normal polarity from the recording medium to the image bearing member, wherein a time T3 during which a current for forming the transfer-direction electric field is applied is longer than a time T4 during which a current for forming the return-direction electric field is applied, and wherein the bias output device supplies the bias current having a relation of $f>(4/d)\times v$, where f is a frequency (Hz) of the bias current, d is a width (mm) of the transfer nip in a direction of rotation of the image bearing member, and v is a speed of rotation (mm/s) of the image bearing member.

11. The transfer device, according to claim 10, wherein the bias output device supplies the bias current such that a ratio of the time T4 in an entire period of bias current is equal to or greater than 4% and equal to or less than 45%.

12. The transfer device, according to claim 10, wherein the bias output device supplies the bias current such that a ratio of the time T4 in an entire period of bias current is equal to or greater than 8% and equal to or less than 40%.

13. The transfer device, according to claim 10, wherein the bias output device supplies the bias current such that the time T4 is equal to or longer than 0.03 msec.

14. The transfer device according to claim 10, wherein the bias output by the bias output device includes a superimposed bias in which a direct current component and an alternating current component are superimposed, and the direct current component is output under constant current control.

15. The transfer device according to claim 14, wherein the bias output device outputs the alternating current component of a peak-to-peak current under constant current control.

16. An image forming apparatus comprising the transfer device of claim 10.

17. The image forming apparatus according to claim 16, wherein the bias applied by the bias output device includes a superimposed bias in which a direct current component and an alternating current component are superimposed, and the direct current component is output under constant current control, wherein the direct current component of the bias is varied depending on a process linear velocity of the image forming apparatus.

18. A transfer device, comprising:

a rotatable image bearing member to bear a toner image on a surface thereof;

a nip forming member to contact the surface of the image bearing member bearing the toner image to form a transfer nip therebetween; and a bias output device to apply a bias to transfer the toner image on the image bearing member onto a recording medium in the transfer nip, the bias output device outputting a bias current to alternately form a transfer-direction electric field to transfer toner charged with a normal polarity in the toner image to move from the image bearing member to the recording medium and a return-direction electric field to return the toner charged with the normal polarity from the recording medium to the image bearing member, wherein a transition time T1 from a first time at which a current for forming the transfer-direction electric field reaches its maximum (It) to a second time at which a current for forming the return-direction electric field reaches its maximum (Ir) is longer than a transition time T2 from the second time to the first time, wherein a time T3 during which a current for forming the transfer-direction electric field is applied is longer than a time T4 during which a current for forming the return-direction electric field is applied, and wherein the bias output device supplies the bias current having a relation of $f>(4/d)\times v$, where f is a frequency (Hz) of the bias current, d is a width (mm) of the transfer nip in a direction of rotation of the image bearing member, and v is a speed of rotation (mm/s) of the image bearing member.

* * * * *